US005219697A

United States Patent [19]

Mori et al.

[11] Patent Number: 5,219,697

[45] Date of Patent: Jun. 15, 1993

[54] TONER FOR DEVELOPING ELECTROSTATIC IMAGE COMPRISING COLOR RESIN PARTICLES HAVING AN IRREGULAR SHAPE

[75] Inventors: Hiromi Mori; Takayuki Nagatsuka, both of Yokohama; Tatsuya Nakamura, Tokyo, all of Japan

[73] Assignee: Canon Kabushiki Kaisha, Tokyo, Japan

[21] Appl. No.: 666,654

[22] Filed: Mar. 8, 1991

[30] Foreign Application Priority Data

Mar. 8, 1990 [JP] Japan ..... 2-55058
May 8, 1990 [JP] Japan ..... 2-116923

[51] Int. Cl.[5] ..... G03G 9/087

[52] U.S. Cl. ..... 430/110; 430/109; 430/904

[58] Field of Search ..... 430/110, 111, 137, 904

[56] References Cited

U.S. PATENT DOCUMENTS 2,297,691 10/1942 Carlson ..... 95/5
4,804,610 2/1989 Mori et al. ..... 430/137
4,816,366 3/1989 Hyosu et al. ..... 430/137
4,868,085 9/1989 Aita ..... 430/125
4,912,010 3/1990 Mori et al. ..... 430/157
4,939,060 7/1990 Tomiyama et al. ..... 430/111
4,960,669 10/1990 Mori et al. ..... 430/137

FOREIGN PATENT DOCUMENTS 56-13945 4/1981 Japan .
57-51676 11/1982 Japan .
59-53856 3/1984 Japan .
59-61842 4/1984 Japan .
62-266560 11/1987 Japan .
63-301960 12/1988 Japan .

*Primary Examiner*—Marion E. McCamish
*Assistant Examiner*—S. Rosasco
*Attorney, Agent, or Firm*—Fitzpatrick, Cella, Harper & Scinto

[57] ABSTRACT

A toner for developing an electrostatic image, comprising color resin particles and a particulate additive. The color resin particles contain at least a coloring agent and a binding resin. The color resin particles possess irregular surfaces but not breaks, and the irregularity may be formed by depositing and fixing onto the surface fine resin particles having an average particle size in a range of 1/200 to 1/10 of the color resin particle size. A particulate additive has an average particles size of not more than 1/10 of volume average particle size of the color resin particles. The BET specific surface area of the toner changes by 20% or less before and after the forced stirring of the toner.

31 Claims, 1 Drawing Sheet

TONER FOR DEVELOPING ELECTROSTATIC IMAGE COMPRISING COLOR RESIN PARTICLES HAVING AN IRREGULAR SHAPE

BACKGROUND OF THE INVENTION

1. Field of the Invention

This invention relates to a toner for developing an electrostatic image, and more particularly to a toner for developing an elctrostatic image formed by electrophotography.

2. Related Background Art

Many electrophotographic processes are known, as disclosed in U.S. Pat. No. 2,297,691, etc.

The electrophotographic process is a process which comprises forming electrostatic latent images on a photosensitive member by various means usually utilizing a photoconductive substance, developing the latent images by a toner, transferring the toner images onto a transfer member such as paper sheet, when required, and then fixing the toner images by heating, pressing or heating-pressing, thereby obtaining a copy.

For the development of latent images by a toner or for fixing toner images, various processes have been so far proposed and processes suitable for the respective image-forming processes have been employed.

Recently, high speed copying and higher image quality have been required in the electrophotographic process, and also the improvement of color miscibility of toners themselves has been in demand as a result of full colorization. Furthermore, fixation at a lower temperature, smaller particle sizes and lower melt viscosity have been required for toners.

A well known, conventional process for preparing a toner comprises melt-mixing a thermoplastic resin, a coloring agent such as a dye or pigment, and an additive such as a charge-controlling agent, uniformly dispersing the components in the mixture, then cooling the molten mixture, finely pulverizing the cooled mixture and classifying the finely pulverized product by a classifier, thereby obtaining a toner with a desired particle size.

For the toner preparation using the pulverization process, a brittleness is required for the binding resin to give a sufficient pulverizability he cooled product. Therefore, the toners prepared by the pullverization process have sharp projections on the surfaces and thus are highly susceptible to further fine pulverization or powdering in the developing unit, resulting in an increased fogged image or unwanted scattering in the machine.

For the fixation of a toner at a lower temperature, a lower melt viscosity is generally required for the resin. Use of a cross-linking agent to give a brittleness is against the fixation of the toner at a lower temperature and thus is not preferable. Furthermore, the toners prepared by the pulverization process are generally in an irregular shape and thus have a limit to faithful reproduction of latent images and are not favorable for the higher image quality. To obtain the higher image quality using toners prepared by the pulverization process, it is necessary to make further size reduction to smaller particle sizes. However, the brittleness relating to the pulverization efficiency of the binding resin is hardly consistent with the fixability and with the heat characteristics relating to the preservability. It is difficult to fully satisfy these properties at the same time.

Other than the toners with irregular shapes prepared by the pulverization process, Japanese Patent Publication No. 56-13945 proposes a process for obtaining a spherical toner by melt spray; Japanese Patent Publication No.57-51676 proposes a process for obtaining a spherical toner by adding a small amount of an organic solvent to toners with irregular shape, followed by stirring under cooling; and Japanese Patent Publications 36-10231 and Japanese Patent Application Laid Open Nos. 59-53856, 59-61842, etc. propose processes for obtaining a spherical toner by suspension polymerization. With these spherical toners having uniform shapes, latent images, particularly edges of the latent images, can be faithfully developed. That is, these spherical toners are suitable for higher image quality. In the case of spherical toners prepared by the polymerization process, reduction of particles to smaller particle sizes can be readily carried out, and thus the polymerization process is more suitable for higher image quality.

Japanese patent Applications Laid-Open Nos. 59-53856, 59-61842, etc. propose processes for obtaining spherical toners containing a release agent by a polymerization process. According to the process, a monomer system is made into particles in water under a high shearing force and thus fine particles can be readily formed, and the nonpolar release agent is included in he particles. Furthermore, a broad allowance can be obtained for the amount of the release agent to be added, because of absence of the pulverization step. Still furthermore, the release agent melts at the hot roll fixation to show a release effect and acts as a good heat couductor, when melted. accelerates the melting rate of the binding resin. Fixation of a toner at a lower temperature and an offset prevention effect can be obtained thereby.

In the case of using resin particles as toners, on the other hand, the toners generally contain various additives as characteristic-endowing agents. For example, a flowability-endowing agent is added to the toners to increase the flowability of toners, or charge-controlling particles are added to the toners to prevent the charge-up of toners.

However, in the case of spherical toners having no breaks, the characteristics are readily deteriorated when mixed with various additives and thus it is hard to obtain a toner with less susceptibility to deterioration and sufficient durability.

With recent full colorization of electrophotographic images, miscibility of at least three colors and fixability of at least three toner layers have been important problems. Japanese Patent Application Laid-Open No. 63-301960 proposes a color toner using polyester resin as a binding resin. The color toner has a considerably high level of color miscibility and fixability, but a further improvement of image quality is required.

In the case of toners prepared by the pulverization process, in which further size reduction is difficult because of the pulverization efficiency in the toner production process and heat characteristics of the toner, it has been required to overcome the poor image quality due to the irregular shapes of the toners.

SUMMARY OF THE INVENTION

An object of the present invention is to provide a toner for developing an electrostatic image, free from the above-mentioned problems.

Another object of the present invention is to provide a toner for developing an electrostatic image, free from or substantially free from changes in the properties during prolonged usage.

Other object of the present invention is to provide a toner for developing an electrostatic image substantially free from fog and toner scattering.

Further object of the present invention is to provide a toner with a high image density having good line reproduction and highlight tone.

Still further object of the present invention is to provide a toner capable of being fixed at a lower temperature and free from offset.

Still further object of the present invention is to provide a toner for developing an electrostatic image, comprising color resin particles containing at least a coloring agent and a binding resin, the color resin particles being substantially free from breaks; and a particulate additive having an average particle size of not more than 1/10 of volume average particle size of the color resin particles, wherein the toner has a change ratio in BET specific surface area not more than 20% before and after the forced stirring of the toner.

DETAILED DESCRIPTION OF THE INVENTION

Figure 1:
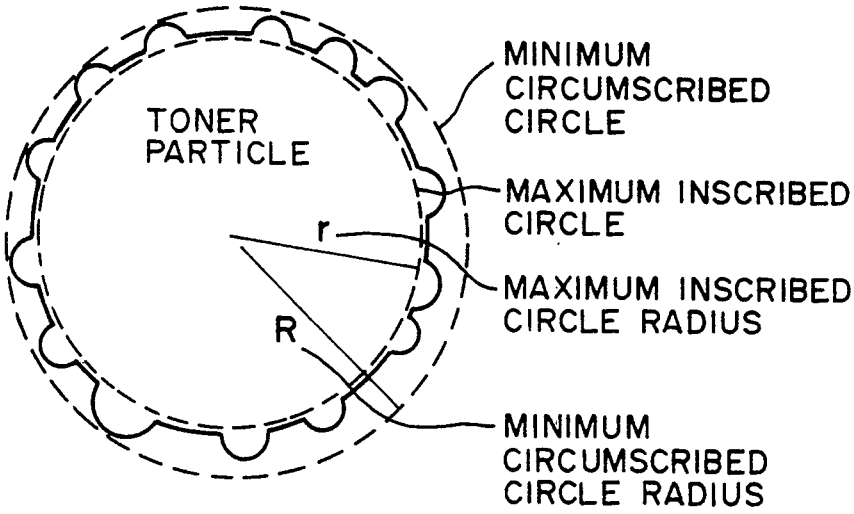
FIG. 1 is a schematic view showing the maximum inscribed circle and the minimum circumscribed circle in the projection chart of a toner according to one embodiment of the present invention.

As a result of extensive studies, the present inventors have found that BET specific surface area of the toner deteriorated by prolonged use is reduced as compared with the BET specific surface area of the toner before the use. The reduction in the BET specific surface of toner seems to be due to the following phenomena; when toners are in a spherical shape having no breaks, a high pressure is liable to develop upon toners during contact with toner particles themselves, with carrier particles and with a sleeve, and the spherical toners having no breaks are more susceptible to rubbing than toners of irregular shape and as a result the additive particles capable of freely moving on the toner surfaces is embedded into the toner particle surfaces and fixed hereto, and thus the function of the additive is considerably impaired and the durability of toners is lowered. These phenomena seem to result in the reduction in the BET specific surface area of toners.

In the present toner, color resin particles having no breaks are used and BET specific surface area of toner does not change more than 20% before and after the forced stirring of toner. Thus the present toner has a good durability. Since the color resin particles have no sharp protrusions on the surfaces, fewer fine powder is formed by stirring in the developing apparatus and consequently fogged images due to an increase in the fine powder or toner scattering in the developing machine hardly occur.

When a change ratio in the BET specific surface area of toner is more than 20%, the additive will be deteriorated, as mentioned above.

Resin particles having no breaks for use in the present invention can be prepared by spherodizing treatment of toners of irregular shape or by polymerization, as mentioned above.

Spherical resin particles contain at least a coloring agent and a binding resin. The binding resin includes, thermoplastic resin, for example, styrene resin, styrene-acrylate ester copolymer, styrene-methacrylate ester copolymer, copolymer of styrene and other vinyl monomer (for example, acrylonitrile, butadiene, etc. , polyester resin, epoxy resin, etc. The thermoplastic resins can be used alone or in mixture thereof.

Among the thermal properties of the binder resin, the glass transition point is 30° to 80° C., preferably 40° to 60° C., from the viewpoint of antiblocking property and fixability.

From the viewpoint of higher image quality, smaller particle size is desirable for the toner particles, for which a melt spray process or a polymerization process is suitable. Particularly a suspension polymerization process, comprising preparing particles of monomer composition in water under a high shearing force followed by polymerization within the particles, is suitable for the smaller particle size of toners.

The color resin particles thus obtained and additive particles having particle size of not more than 1/10 of volume average size of the color resin particles are mixed together to prepare toners.

The present invention is directed to toners having a change ratio in the BET specific surface area of not more than 20%, preferably not more than 15%, more preferably not more than 10%, before and after the forced stirring, as will be described in detail later. In order not to exceed 20% in the change ratio for the BET specific surface area of toners, it is preferable to add the following steps to the process for preparing toners, whereby the surfaces of color resin particles are made irregular:

(1) Mechanochemical process: After the mixing of the sphered color resin particles with the fine resin particles, the mixture is subjected to a mechanochemical process to melt deposit the fine resin particles onto the surfaces of toner particles.

(2) Dry-process heat treatment: After the mixing of the sphered color resin particles with the fine resin particles, the mixture is heated in a fluidized heating bed to melt-deposit the fine resin particles onto the surfaces of toner particles.

(3) Wet-process heat treatment: After the mixing of the sphered color resin particles with the fine resin particles in a liquid or gas, the mixture is subjected to a heat treatment in the liquid to melt-deposit the fine resin particles onto the surfaces of the color resin particles.

(4) Addition of the fine resin particles to the color resin particles at the polymerization of the color resin particles: In the case of obtaining the color resin particles by polymerization, the fine resin particles are added to the monomer in advance or during the polymerization, and the fine resin particles are transferred onto the surfaces of the color resin particles before completion of the polymerization by controlling the physical properties of the fine resin particles or a dispersion medium.

(5) Swelling, followed by drying: After the color resin particles are dipped in a solvent to swell the particles, the swollen particles are dried under a hot gas stream or under reduced pressure. Spherodizing treatment can be carried out at the same time.

Fine resin particles for use in the present invention to make the surfaces of color resin particles irregular must have particle sizes of 1/200 to 1/10, preferably 1/100 to 1/10, of the volume average particle size of the color resin particles, and the resin for the fine particles is properly selected from the above-mentioned thermoplastic resins.

There is also a process for obtaining particles of irregular shapes such as potato-like shapes or potbelly shapes by disturbing the stability of suspended particles during the suspension polymerization. The stability of suspended particles can be disturbed by changing the number of revolution of a disperser during the suspension polymerization or by changing the pH value of polymerization system.

It is preferable to prevent the deterioration of various additives due to prolonged use by giving appropriate irregularity to the surfaces of toner particles having no breaks not substantially changing the shape. If the shape is given high irregularity, it is not much different from the so-called irregular shape so that fine pulverization is liable to occur in the developing machine giving an adverse effect on higher image quality, though the deterioration of additives due to prolonged use is eliminated. Thus, it is not preferable to give irregularity to the surfaces of toner particles having no breaks. In other words, it is preferable that the present toners are substantially spherical and have fine irregularity on the surfaces. It is also preferable that the color resin particles of the present invention are substantially spherical, as mentioned before. It is thus preferable that there is the following relationship between the radius of maximum inscribed circle and the radius of minimum circumscribed circle in the projection chart of color resin particle:

$$1.00 < R/r < r \leqq 1.20$$

The shape deviates from the spherical shape when R/r is larger. When R/r exceeds 1.20, it is hard to obtain the characteristics of spherical color resin particles. Volume average particle size of the spherical color resin particles is 2–20 μm, preferably 3–12 μm, more preferably 4–10 μm.

Furthermore, it is preferable to satisfy the following relationship in the projection chart of the color resin particle between the circumferential length L of the color resin particle and the circumferential length Q of the maximum inscribed circle:

$$1.01\ Q < L < 2.00\ 1$$

When the circumferential length L is less than 1.01 Q, there is substantially no irregularity, whereas, when L is over 2.00 Q, there are many smaller irregularities than the particle sizes of additives and thus it is hard to prevent the deterioration of the additives.

Figure 2:
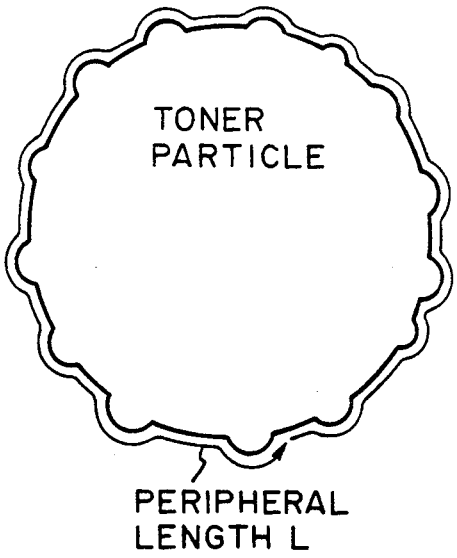
FIG. 2 is a schematic view showing the circumferential length L in the projection chart of a toner according to one embodiment of the present invention.

In the present invention the projection chart of color resin particle means an image or picture obtained by an electron microscope focusing on the contour of color resin particle with a magnification of at least ×2,000, preferably ×5,000. Furthermore, the radius r of maximum inscribed circle and the radius R of minimum circumscribed circle are determined with Luzex 5000, as shown in FIG. 1, and the circumferential length L of color resin particle is determined as shown in FIG. 2.

R, r and L of at least 50, preferably 100 or more projection charts of color resin particles are measured. In the present toners, it is preferable that more than 50%, preferably more than 70%, more preferably more than 90% of color resin particles satisfy the foregoing relationships.

It is also preferable that the additives used in the present invention to give various characteristics to the color resin particles have particle sizes not more than 1/10 of volume average particle size of the color resin particles. The particle size of additives means average maximum particle diameter of the additives present on the surfaces of color resin particles by observation of the surfaces of color resin particles with an electron microscope (magnification: 10 000). It is preferable to determine the average particle sizes of the additives from at least 100 color resin particles.

The additives to give various characteristics to the color resin particles include the following members:

1) Flowability-endowing agent: Metal oxide powder such as silicon oxide powder, aluminum oxide powder, titanium oxide powder, etc.; carbon black powder, carbon fluoride powder, etc. each of which preferably are treated for hydrophobicity.

2) Abrasive agent: Metal oxide powder such as strontium titanate powder, calcium oxide powder, aluminum oxide powder, magnesium oxide powder, chromium oxide powder, etc.; nitride powder such as silicon nitride powder, etc.; carbide powder such as silicon carbide powder, etc.; metal salt powder such as calcium sulfate powder, barium sulfate powder, calcium carbonate powder, etc.

3) Lubricant: Fluorine-containing resin powder such as vinylidene fluoride resin powder, polytetrafluoroethylene powder, etc.; metal salt powder of fatty acid such as zinc stearate powder, calcium stearate powder, etc.

4) Charge-controllable particles: Metal oxide powder such as tin oxide powder, titanium oxide powder, zinc oxide powder, silicon oxide powder, aluminum oxide powder, etc.; carbon black powder, etc.

The additives are used in 0.1 to 10 parts by weight, preferably 0.1 to 5 parts by weight, more preferably 0.1 to 2 parts by weight, on the basis of 100 parts by weight of the color resin particles. The additives are used alone or in combination thereof.

Well-known dyes and pigments can be used in the present invention as the coloring agent. The dyes include, for example, C.I.Direct Red 1, C. I. Direct Red 4. C. I. Acid Red i. C.I.Basic Red 1, C. I. Mordant Red 30, C. I. Direct Blue 1, C I. Direct Blue 2, C. I. Acid Blue 9, C. I. Acid Blue 15, C.I. Basic Blue 3, C. I. Basic Blue 5, C. I. Mordant Blue 7, C. I. Direct Green 6, C. I. Basic Green 4, and C. I. Basic Green 6. The pigments include carbon black, Iron Black, Chrome Yellow, Cadmium Yellow, Mineral Fast Yellow, Navel Yellow, Naphthol Yellow S, Hanza Yellow G, Permanent Yellow NCG, Tartazine Lake Molybden Orange, Permanent Orange GTR, Benzidine Orange G, Cadmium Red, Permanent Red 4R, Watching Red Calcium Salt, Brilliant Carmine 3B, Fast Violet B, Methylviolet Lake, Prussian Blue, Cobalt Blue. Alkali Blue Lake, Victoria Blue Lake, Quinacridone, Rhodamine B, Phthalocyanine Blue, Fast Sky Blue, Pigment Green B, Malachite Green Lake and Final Yellow Green G.

Preferable pigments are Diazo Yellow pigments, insoluble azo pigments and copper phthalocyanine pigments. Preferable dyes are basic dyes and oil-soluble dyes.

Particularly pigments are C. I. Pigment Yellow 17, C. I. Pigment Yellow 15, C. I. Pigment Yellow 13, C. I. Pigment Yellow 14, C. I. Pigment Yellow 12, C. I. Pigment Red 5, C. I. Pigment Red 3, C. I. Pigment Red 2, C. I. Pigment Red 6, C. I. Pigment Red 7, C. I. Pigment Blue 15, C. I. Pigment Blue 16, and copper phthalocyanine pigments having the following structural formula (I), where the phthalocyanine skelton has 1 to 3 phthalimidoalkyl groups as substituents:

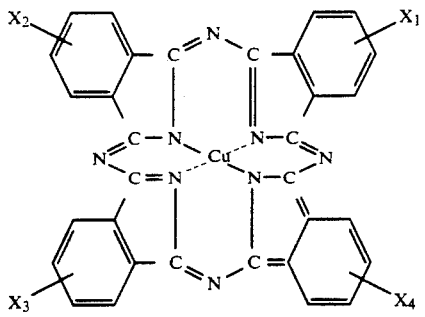

(I)

where $X_1$ to Xy are

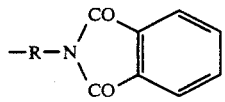

H and R is an alkylene group having 1 to 5 carbon atoms, except the case that all of $X_1$ to Xy are —H.

When toners are prepared by polymerization, precautions must be taken for the polymerization inhibition and for transfer into the water phase of coloring agents. It is preferable to modify the surfaces of coloring agents, for example, changing the coloring agents hydrophobic with a substance which does not inhibit polymerization.

When toners are used as magnetic toners, magnetic particles are added to the color resin particles. As the magnetic particles, materials that can be magnetized when placed in a magnetic field are used. The magnetic particles include, for example, powder of ferromagnetic metal such as iron powder, cobalt powder, nickel powder, etc.; powder of alloys of these metals; and powder of such compound as magnetite and ferrite. These magnetic particles generally have a hydrophilic property and thus uniform dispersion of these magnetic particles into polymaizable monomers is hard to obtain. Thus, it is preferable to apply a hydrophobic modification to the surfaces of the magnetic particles.

As the hydrophobic modification, well-known methods are applicable, which includes, for example, treatment with a silane coupling agent having such functional groups as amino group, isocyanate group, epoxy group and vinyl group; treatment with a titanium coupling agent; treatment with a compound having a reactive functional group such as amino group, isocyanate group and epoxy group as well as lipophilic group; and treatment with reactive polyorganosiloxane.

Of the magnetic particles already subjected to the lipophilic treatment; the particle size is 0.05 to 1 μm, preferably 0.1 to 0.5 μm. BET specific surface area is 1 to 15 $m^2/g$, preferably 3 to 12 $m^2/g$, bulk density is 0.2 to 1.0 $g/cm^3$, preferably 0.4 to 1.0 $g/cm^2$.

When the present magnetic toners are used in the jumping development process, it is preferable that the toners have a coercivity (Hc) of 50 to 150 Oe. preferably 80 to 140 Oe, and a saturation magnetization ($\sigma s$) of 40 to 100 emu/g, preferably 60 to 80 emu/g in the magnetic field of 1,000 oersteds, as magnetic characteristics. When magnetic toners of small particle sizes, i.e., not more than 9 μm in the average particle size, are formed, it is preferable to use magnetic particles having particle sizes of not more than 0.8 μm.

It is preferable that the content of the magnetic particles is 20 to 70% by weight, preferably 30 to 60% by weight, on the basis of the monomer composition.

In order to improve the releasability of toner from the fixing member on heated press fixing such as hot roll fixing, thereby obtaining low temperature fixing and offset prevention effect of toners, a release agent is added to the color resin particles. The release agent for use in the present invention includes, for example, paraffin wax, polyolefin-based wax and their modified products, such as oxides and grafted products, higher fatty acids and metal salts of higher fatty acids, amide wax, etc. It is preferably that the wax has a softening point of 40° to 130° C., preferably 50° to 120° C. according to the ring and ball method (JIS K 2531). With a softening point below 40° C., the antiblocking property and shape retainability of toners will be unsatisfactory, whereas with a softening point above 130° C., the release effect will be also unsatisfactory.

In order to control the chargeability of toners, it is preferable in the present invention to add a charge-controlling agent into the color resin particles or into the fine resin particles used for irregular surface formation. As the charge-controlling agent, well known agents are used. For example nigrosine dye, triphenylmethane dye, quaternary ammonium salts, and amine and polyamine compounds are used as a positive charge-controlling agent. Salycyclic acid-based metal compounds, monoazo dye metal compounds, styrene-acrylic acid copolymers and styrene-methacrylic acid copolymers are used as a negative charge-controlling agent.

Particle size distribution of the color resin particles is determined in the following procedure in the present invention.

Coulter counter, type TA-II (made by Coulter Co.) is used as an instrument for the determination, to which an interface (made by Nikkaki K. K.) and CX-1 personal computer (made by Canon are connected for outputting number average distribution and volume average distribution, using an aqueous 1% NaCl (Grade 1) solution as an aqueous electrolytic solution.

Then, 0.1 to 5 ml of a surfactant, preferably alkylbenzene sulfonate, is added to 100 to 150 ml of the aqueous electrolytic solution, and then 0.5 to 50 mg of a sample is added thereto.

The aqueous electrolytic solution containing the sample is subjected to a dispersion treatment in an ultrasonic dispersing unit for about 1 to about 3 minutes and then particle distribution of particles having particle sizes of 2 to 40 μm is measured by the Coulter Counter type TA-II wi&h a 100 μm aperture to determine volume average distribution and number average distribution. From the thus obtained volume average distribution and number average distribution, the volume average particle size of the color resin particles is determined.

When the present toners are used together with a carrier in a binary developing agent, the magnetic particles for the carrier include, for example, surface-oxidized or unoxidized powder of metals such as iron, nickel, copper, zinc, cobalt, manganese, chromium, rare earth elements, etc., or their alloys or oxides, and ferrite. There is no special restriction to their production process.

In the present invention, it is preferable to coat the surfaces of the magnetic particles with a coating material such as resin according to a well known process such as a process comprising dissolving or suspending a coating material such as resin in a solvent and applying the solution or suspension to the surfaces of magnetic particles, thereby depositing the coating material on the magnetic particles, or a process for mixing the magnetic particles with a coating material in a powdery state. For the stabilization of the coating layer, the former process (dissolving the coating material in a solvent and applying the solution to the surfaces of magnetic particles) is preferable.

The coating material to the surfaces of magnetic particles depends upon the kind of toner material; Positively chargeable resin preferably includes aminoacrylate resin, acrylic resin or copolymers of styrene resin with these resins, because these resins locate as the positive chargeable resin in the triboelectric series. Negatively chargeable resin preferably includes silicone resin, polyester resin, polytetrafluoroethylene, monochlorotrifluoroethylene polymer, polyvinylidene fluoride, etc., because these resins locate as the negatively chargeable resin in the triboelectric series.

A change ratio in the BET specific surface area (referred as change ratio in this specification) of toner is determined in the following manner.

At first, the BET specific surface area of toners is measured using Antosorb 1 (apparatus for full automatic measurement of adsorbed gas amount, "Antosorb" made by Yuasa-Ionics K. K.). Then, 10 g of powdery mixture consisting of 6 parts by eight of toners and 94 parts by weight of spherical, resin-coated ferrite carrier of 300 mesh pass (US standard sieve) to 400 mesh on (US standard sieve), where the ferrite powder is coated with 0.2 to 0.7% by weight of acrylic resin on the basis of ferrite powder is placed in a polyethylene container having a capacity of 50 cc. The container is subjected to stirring and mixing in a tumbler mixer at 2 cycles/sec for 20 minutes. After the mixing, the toner is separated from the spherical, resin-coated ferrite carrier, and the BET specific surface area of the separated toners is measured.

$$\text{Change ratio (\%)} = \frac{\text{BET specific surface area of toners before stirring } (m^2/g) - \text{BET specific surface area of toners after stirring } (m^2/g)}{\text{BET specific surface area of toners before stirring } (m^2/g)} \times 100$$

Preferably, the color resin particles for use in the present invention have volume average particle size of 2 to 20 μm, preferably 3 to 12 μm, more preferably 4 to 10 μm.

A change ratio (%) of one-component magnetic toner or one-component nonmagnetic toner can be also determined in the same procedure as above.

On the one-component magnetic toner, it is possible to roughly determine a change ratio (%) of the magnetic toner by placing the magnetic toner in a developing unit for one-component magnetic toners, rotating a developing sleeve for about 30 minutes without developing the images in such a state that the magnetic toner may not be consumed, and measuring the BET specific surface area of magnetic toner before and after the rotation of the developing sleeve. For example, a change ratio (%) can be roughly determined by placing the magnetic toner in the developing unit of copying machine NP-6650 made by Canon (developing sleeve diameter: about 32 mm; circumferential speed: about 390 mm/sec.) continuously rotating the developing sleeve for 30 minutes, measuring the BET specific surface area of the magnetic toners in the developing sleeve and comparing the thus measured BET specific surface area with that of magnetic toner before the placement in the developing unit.

The present invention will be explained in detail below, referring to Examples, where parts means by weight.

PREPARATION EXAMPLE OF SPHERICAL COLOR RESIN PARTICLES (1)

| | |
|---|---|
| Styrene | 170 parts |
| 2-ethylhexyl acrylate | 30 parts |
| C.I. Pigment Blue 15:3 (coloring agent) | 7 parts |
| Paraffin Wax (m.p: 155° F.) (release agent) | 32 parts |
| Cyclized rubber (polar polymer) | 10 parts |

The above-mentioned components were heated to a temperature of 60° C. in a container to dissolve or disperse the components, and then 10 parts of 2,2'-azobis (2,4-dimethylvalenonitrile) was added thereto to prepare a monomer composition.

Separately, 10 parts of hydrophilic colloidal silica treated with a silane coupling agent was added to 1,200 parts of deionized water and the resulting aqueous dispersion medium was adjusted to pH 6 with hydrochloric acid.

Then, the monomer composition was added to the aqueous dispersion medium, and the resulting mixture was subjected to a recycle dispersion treatment at 8,000 rpm for 20 minutes in a Hiline mill, type 25 (made by Tokushu Kika Kogyo K. K.) at a temperature of 60° C. in a nitrogen atmosphere to granulate the monomer composition. Furthermore, the mixture was stirred with heating at a temperature of 60° C. with paddle stirring blades till the polymerization degree detected by residual monomer assay by gas chromatography that the polymerization degree reached 95% or more. Then the polymerization temperature was elevated to 80° C., and the paddle blades were replaced with T.K. Type Homomixer (made by to Tokushu Kiko Kogyo K. K.) to conduct stirring at 5,000 rpm for 15 minutes. Then, stirring was continued again with the paddle blades to complete the polymerization.

The reaction product was cooled, admixed with sodium hydroxide to dissolve the colloidal silica, and then washed with water, filtered and dried, whereby color spherical resin particles were obtained. Particle size of the color resin particles was measured by Coulter counter (aperture diameter: 100 μm) and volume average particle size was found to be 4.2 μm. Glass transition point of the color resin particle was found to be 55° C. by differential scanning calorimetry (DSC).

PREPARATION EXAMPLE OF SPHERICAL COLOR RESIN PARTICLES (2)

Preparation was carried out in the same manner as in Preparation Example 1 except that the granulation step was conducted with a T.K. type Homomixer under a nitrogen gas atmosphere and the conditions for the dispersion treatment were changed to 80° C./6.500 rpm/60 minutes, whereby spherical color resin particles having a volume average particle size of 12.2 μm by Coulter counter (aperture diameter: 100 μm) and a glass transition point of 56° C. were obtained.

PREPARATION EXAMPLE OF SPHERICAL COLOR RESIN PARTICLES (3)

| | |
|---|---|
| styrene-n-butyl methacrylate copolymer (monomer molar ratio = 82:18; Mw = 53,000) | 100 parts |
| Low molecular weight polyethylene as a release agent (softening point: 110° C.) | 4 parts |
| Carbon black as a coloring agent | 5 parts |
| di-t-butylsalicyclic acid metal compound as a negative charge-controlling agent | 4 parts |

A mixture of the foregoing components was melted and kneaded in a roll mill at a temperature of 150° C. to obtain a kneaded color resin mixture. The mixture was melted by heating to a temperature of 200° C., and the molten mixture was supplied to a two-fluid nozzle using a hot compressed gas at a temperature of about 500 ° C. and a pressure of 3 kg/cm$^2$ to granulate the molten mixture by spraying. The sprayed granules were immediately cooled and classified, whereby spherical color resin particles having a volume average particle size of 7.8 μm determined by Coulter counter (aperture diameter: 100 μm) were obtained. The color resin particles had a glass transition point of 60° C.

PREPARATION EXAMPLE OF SPHERICAL COLOR RESIN PARTICLES (4)

| | |
|---|---|
| styrene-n-butyl acrylate copolymer (monomer molar ratio = 82:18; Mw = 14,000) | 100 parts |
| Low molecular weight polypropylene (softening point = 105° C.) | 4 parts |
| Hydrophobically modified magnetite as magnetic particles and coloring agent (average particle size: 0.2 μm) | 60 parts |
| Nigrosine dye as a charge-controlling agent | 2 Parts |

A mixture of the above-mentioned components was melted and kneaded in a roll mill at a temperature of 150° C., and the resulting kneaded product was cooled and roughly ground in a cutter mill and then finely pulverized in a jet mill, followed by pneumatic classification. Black resin particles of irregular shape having a volume average particle size of 11.7 μm by Coulter counter (aperture diameter: 100 μm) were obtained.

The thus obtained black resin particles of irregular shape were mixed with hydrophilic colloidal silica, and then the resulting mixture was dispersed in water and subjected to a heating and pressing treatment in an autoclave under conditions of 130° C./2.2 kg/cm$^2$/30 minutes to conduct a spheroidizing treatment.

After the cooling, the mixture was treated with sodium hydroxide to dissolve the silica, and then subjected to water washing, filtration and drying, whereby magnetic, spherical color resin particles having a volume average particle size of 9.8 μm by Coulter counter aperture diameter: 100 μm) were obtained. The color resin particles had a glass transition point of 50° C.

PREPARATION EXAMPLE OF SPHERICAL COLOR RESIN PARTICLES (5)

| | |
|---|---|
| Polyester resin (propylene oxide and fumaric acid adduct of bisphenol A and fumaric acid) | 100 parts |
| C.I. Pigment Yellow as a coloring agent | 8.5 parts |
| di-t-butylsalicyclic acid metal compound as a charge-controlling agent | 4 parts |

The above-mentioned components were subjected to preliminary mixing in a Henschel mixer, and melted and kneaded at least twice in a three-roll mill, and after cooling the melt mixture was roughly ground in a hammer mill and finely pulverized in a jet mill, followed by pneumatic classification. Color resin particle of irregular shape having a volume average particle size of 11.5 μm by Coulter counter (aperture: 100 μm) were obtained.

The thus obtained color resin particles were mixed with positively chargeable, hydrophilic colloidal silica, and the resulting mixture was dispersed in water in a flask and subjected to a heating treatment at 75° C. for 30 minutes with stirring to conduct spheroidizing treatment. After the cooling, the mixture was treated with sodium hydroxide to dissolve the silica and then subjected to water washing, filtration and drying, whereby spherical color resin particles having a volume average particle size of 9.5 μm by Coulter counter (aperture diameter: 100 μm) were obtained. The color resin particles had a glass transition point of 66° C.

PREPARATION EXAMPLE OF SPHERICAL COLOR RESIN PARTICLES (6)

| | |
|---|---|
| Styrene | 183 Parts |
| 2-ethylhexyl acrylate | 17 parts |
| Paraffin wax as a release agent (m.p = 155° F.) | 32 parts |
| C.I. Pigment yellow 17 as a coloring agent | 7 parts |
| Styrene-methacrylic acid-methyl methacrylate copolymer (molar ratio = 88:10:2; Mw = 58,000) | 10 parts |

The above-mentioned components were heated to a temperature of 70° C. in a container and melted and dispersed in a T.K.type homomixer to prepare a monomer mixture. Then, 10 parts of dimethyl 2,2'-azo. bisisobutyrate as a polymerization initiator was added thereto, while maintaining the mixture at a temperature of 70° C. to prepare a monomer mixture.

Separately, 0.25 g of γ-aminopropylmethoxy silane was added to 1,200 ml of deionized water, and furthermore 5 g of hydrophilic colloidal silica was added thereto. The resulting mixture was heated to a temperature of 70° C. and dispersed with a T.K. Type homomixer (type M made by Tokushu Kiko Kogyo K. K.) at 10,000 rpm for 5 minutes to prepare an aqueous dispersion medium. The aqueous dispersion medium was adjusted to pH 6 with 1/10 N HCl.

The monomer composition was added to the thus prepared aqueous dispersion medium in a 2-1 flask and stirred at 70° C. in a nitrogen atmosphere with a T.K type homomixer at 9,000 rpm for 60 minutes to prepare a monomer composition. Then, the composition was polymerized at a temperature of 70° C. for 20 hours with stirring with paddle blades. After the completion of the polymerization reaction, the reaction product was cooled and admixed with NaOH to dissolve the colloidal silica, and then subjected to filtration, water washing and drying, whereby spherical color resin particles were obtained.

Particle size of the thus obtained spherical color resin particles was measured by Coulter counter (aperture diameter: 100 μm) and the particles were found to have a sharp particle size distribution with a volume average particle size of 8.7 μm.

PREPARATION EXAMPLE OF SPHERICAL COLOR RESIN PARTICLES (7)

| | |
|---|---|
| Styrene | 183 Parts |
| 2-ethylhexyl acrylate | 17 parts |
| Paraffin wax (T-550, made by Taisei Kosan K.K.) | 16 parts |
| C.I. Pigment yellow 17 | 7 Parts |
| di-t-butylsalicyclic acid metal compound | 3 parts |

Spherical color resin particles having a volume average particle size of 12.0 μm were prepared in the same manner as in preparation Example 6 except that the above-mentioned components were used and the number of revolution of the homogenizer for the granulation was changed to 7,500 rpm.

PREPARATION EXAMPLE OF SPHERICAL COLOR RESIN PARTICLES (8)

Spherical color resin particles having a volume average particle size of 5.6 μm were prepared in the same manner as in Preparation Example 1, except that the number of revolutions, 8,000 rpm, was changed 7,000 rpm in the recycle dispersion treatment for the granulation of the monomer composition in preparation Example 1.

PREPARATION EXAMPLE OF SPHERICAL COLOR RESIN PARTICLES (9)

One hundred parts of polyester resin obtained by condensation of bisphenol A propylene oxide adduct and fumaric acid, 5 parts of phthalocyanine pigment and 4.4 parts of a metal-containing organic compound were subjected to thorough preliminary mixing in a Henschel mixer, and the resulting mixture was melted and kneaded at least twice in a three-roll mill, and then cooled. The cooled product was crushed to particle sizes of about 1 to about 2 mm in a hammer mill and then finely pulverized to particle sizes of not more than 30 μm by a pulverizer based on an air jet system, whereby color resin particles having breaks and an irregular shape were Obtained.

One hundred parts of the color resin particles and 5 parts of hydrophilic colloidal silica treated with an amino silane coupling agent were subjected to preliminary mixing in a Henschel mixer, and then 500 parts of water was added thereto. Then, the mixture was stirred and dispersed with paddle blades to prepare an aqueous dispersion. Then, the aqueous dispersion was heated to a temperature of 75° C., while stirring the dispersion, kept at that temperature for 60 minutes and left for cooling. Then, sodium hydroxide was added to the aqueous dispersion to dissolve the silica, followed by filtration, washing, drying and classification. Spherical color polyester particles having a volume average particle size of 8.5 μm were obtained thereby. The optical microscope inspection showed that the thus obtained color resin particles were in a spherical shape.

PREPARATION EXAMPLE OF SPHERICAL COLOR RESIN PARTICLES (10)

Color polyester resin particles having a volume average particle size of 11.8 μm were prepared in the same manner as in Preparation Example 9 except that the polyester resin has obtained by condensation of bisphenol A propylene oxide adduct, terephthalic acid and n-dodecenylsuccinic acid. Optical microscope inspection showed that the color resin particles were in a spherical shape.

PREPARATION EXAMPLE OF SPHERICAL COLOR RESIN PARTICLES (11)

Color resin particles having an irregular shape were prepared in the same manner as in Preparation Example 9 except that the particle size of color resin particles having an irregular shape was further reduced. Then, the color resin particles were subjected to the same spheroidizing treatment as in Preparation Example 9 to obtain spherical color polyester resin particles having a volume average particle size of 5.8 μm. The optical microscope inspection showed that the thus obtained color resin particles were in a spherical shape.

PREPARATION EXAMPLE OF FINE RESIN PARTICLES FOR IRREGULAR SURFACE FORMATION (1)

| | |
|---|---|
| Methyl methacrylate | 100 parts |
| Deionized water | 200 parts |
| Potassium persulfate | 0.3 parts |
| Sodium laurylsulfate | 1 parts |
| Polyoxyethylenenonylphenyl ether | 4 parts |

The above-mentioned components were mixed and stirred under a nitrogen gas stream at a temperature of 80° C. for 4 hours to conduct emulsion polymerization. Then, 10 parts of methacrylic acid was added thereto and the polymerization was continued for two hours. After the completion of the polymerization, the polymerization product was cooled, washed with water, filtered and dried, whereby fine colorless, spherical resin particles having a volume average particle size of 0.05 μm by Coulter counter N4 were obtained.

PREPARATION EXAMPLE OF FINE RESIN PARTICLES FOR IRREGULAR SURFACE FORMATION (2)

Into a reactor vessel 150 parts of deionized water was placed and heated to a temperature of 80° C. Then, 1 part of monomer mixture consisting of styrene/n-butyl methacrylate (=90/10 wt/wt) and 10 parts of an aqueous 10% ammonium persulfate solution was added thereto. Then, 99 parts of the monomer mixture was dropwise added thereto over 3 hours to obtain seed latex. Then, 10 parts of methacrylic acid was dropwise added thereto and the polymerization was continued for one hour. After the completion of the polymerization, the polymerization product was cooled, washed with water, filtered and dried, whereby fine colorless, spherical resin particles having a volume average particle size by Coulter counter N4 were obtained.

PREPARATION EXAMPLE OF FINE RESIN PARTICLES FOR IRREGULAR SURFACE FORMATION (3)

| | |
|---|---|
| Methyl methacrylate | 80 Parts |
| Deionized water | 800 parts |
| Polyvinyl alcohol | 0.4 parts |

The above-mentioned components were heated to a temperature of 70° C. under a nitrogen gas stream and stirred. Then, 0.8 parts of 2,2'-azobis (2-amidinopropane) dihydrochloride was added thereto as a polymerization initiator. The mixture was stirred for 3 hours to conduct polymerization. After the completion of the polymerization, the polymerization product was cooled, washed with water, filtered and dried, whereby fine colorless spherical resin particles having a volume average particle size of 0.6 μm by Coulter counter N4 obtained.

PREPARATION EXAMPLE OF FINE RESIN PARTICLES FOR IRREGULAR SURFACE FORMATION (4)

In a reactor vessel 900 parts of deionized water and 4 parts of amphoteric ion type, oligoester compound (Mw=1,600) were placed and heated to a temperature of 80° C. Then, 10 parts of an aqueous 10% ammonium persulfate solution was added thereto with stirring, and then 100 parts of a monomer mixture of styrene-n-butyl acrylate (=90/10 wt/wt) was dropwise added thereto over 2 hours. Then, after further dropwise addition of 10 parts of methacrylic acid, polymerization was continued for 3 hours. After the completion of the polymerization, the polymerization product was cooled, washed with water, filtered and dried, whereby five colorless spherical resin particles having a volume average particle size of 0.14 μm by Coulter counter N4 were obtained.

PREPARATION EXAMPLE OF FINE RESIN PARTICLES FOR IRREGULAR SURFACE FORMATION (5)

In a reactor vessel 150 parts of deionized water was placed and heated to a temperature of 80° C. Then, 1 part of a monomer mixture of styrene/n-butyl methacrylate (=90/10 wt/wt) and 10 parts of an aqueous 10% ammonium persulfate solution were added thereto with stirring. Then, 99 parts of the monomer mixture was dropwise added thereto over 3 hours, and then 10 parts of methacrylic acid was dropwise added thereto. Polymerization was continued for one hour. After the completion of the polymerization, the polymerization product was cooled, washed with water, filtered and dried, whereby fine spherical resin particles A having a volume average particle size of 0.5 μm by Coulter counter N4 were obtained.

PREPARATION EXAMPLE OF FINE RESIN PARTICLES FOR IRREGULAR SURFACE FORMATION (6)

| | |
|---|---|
| Methyl methacrylate | 80 parts |
| Deionized water | 800 parts |
| Polyvinyl alcohol | 0.4 parts |

The above-mentioned components were heated to 70° C. under a nitrogen gas stream and stirred. Then, 0.8 parts of 2,2'-azobis (2-amidinopropane) dihydrochloride was added thereto as a polymerization initiator and the methyl methacrylate was polymerized with stirring for 3 hours. After the completion of the polymerization, the polymerization product was cooled, washed with water, filtered and dried, whereby fine spherical resin particles B having a volume average particle size of 0.6 μm by Coulter counter N4 were obtained.

EXAMPLES OF IRREGULAR SURFACE FORMATION (1)-(23)

The spherical color resin particles obtained in any one of preparation Examples 1 to 11 were mixed with the fine colorless resin particles obtained in any one of preparation Examples for irregular surface formation, and the resulting mixture was mixed and dispersed in a Henschel mixer to prepare mixed particles. Then, the mixed particles were added to an aqueous dispersion medium prepared by dispersing a dispersant (positively chargeable, hydrophilic colloidal silica or mere hydrophilic colloidal silica) in 600 parts of deionized water, and the mixture was subjected to an immobilization treatment with heating and stirring. After the immobilization treatment, the aqueous dispersion was cooled and subjected to removal of the dispersant, followed by water washing, filtration and drying, whereby color resin particles having irregular surfaces were obtained. Data of the thus obtained color resin particles having irregular surfaces are shown in table 1.

TABLE 1

| Example No. of irregular surface formation | Preparation Example No. of spherical resin particles (parts) | Preparation Example No. of fine resin particles (parts) | Dispersant (parts) | Conditions for immobilization treatment | Conditions for removal of dispersant (parts) | | Properties of particles with irregular surfaces: Volume average particle size (μm) | R/r | L/Q |
|---|---|---|---|---|---|---|---|---|---|
| 1 | 2 (50) | 2 (5) | Positively chargeable hydrophilic colloidal silica (4) | 110° C./1.2 kg/cm²/30 min. in autoclave | aq. 20% NaOH solution (42) | 48 hr | 12.7 | 1.13 | 1.36 |
| 2 | 1 (50) | 1 (2) | Positively chargeable hydrophilic colloidal silica (3) | 110° C./1.2 kg/cm²/30 min. in autoclave | aq. 20% NaOH solution (42) | 48 hr | 4.3 | 1.02 | 1.12 |
| 3 | 5 (50) | 2 (6) | Positively chargeable hydrophilic colloidal silica (4) | 110° C./1.2 kg/cm²/30 min. in autoclave | aq. 20% NaOH solution (42) | 48 hr | 10.1 | 1.09 | 1.18 |
| 4 | 4 (50) | 3 (1.5) | hydrophilic colloidal silica (3) | 75° C./45 min. | aq. 20% NaOH solution (42) | 48 hr | 10.5 | 1.14 | 1.20 |
| 5 | 3 (50) | 2 (5) | Positively chargeable hydrophilic colloidal silica (4) | 110° C./1.2 kg/cm²/30 min. in autoclave | aq. 20% NaOH solution (42) | 48 hr | 8.8 | 1.16 | 1.26 |

TABLE 1-continued

| Example No. of irregular surface formation | Preparation Example No. of spherical resin particles (parts) | Preparation Example No. of fine resin particles (parts) | Dispersant (parts) | Conditions for immobilization treatment | Conditions for removal of dispersant (parts) | | Properties of particles with irregular surfaces: Volume average particle size (μm) | R/r | L/Q |
|---|---|---|---|---|---|---|---|---|---|
| 6 | 3 (50) | 1 (6) | Positively chargeable hydrophilic colloidal silica (4) | 110° C./1.2 kg/cm$^2$/30 min. in autoclave | aq. 20% NaOH solution (42) | 48 hr | 7.9 | 1.04 | 1.09 |
| 7 (Comp. Ex.) | 2 (50) | 2 (13) | Positively chargeable hydrophilic colloidal silica (4) | 110° C./1.2 kg/cm$^2$/30 min. in autoclave | aq. 20% NaOH solution (42) | 48 hr | 12.3 | 1.02 | 2.10 |
| 8 (Comp. Ex.) | 1 (50) | 2 (12) | Positively chargeable hydrophilic colloidal silica (4) | 110° C./1.2 kg/cm$^2$/30 min. in autoclave | aq. 20% NaOH solution (42) | 48 hr | 5.0 | 1.22 | 1.30 |
| 9 (Comp. Ex.) | 1 (50) | 1 (5) | Positively chargeable hydrophilic colloidal silica (4) | 110° C./0.5 kg/cm$^2$/30 min. in autoclave | aq. 20% NaOH solution (42) | 48 hr | 4.4 | 1.05 | 2.15 |
| 10 | 6 (50) | 2 (5) | Positively chargeable hydrophilic colloidal silica (4) | 110° C./1.2 kg/cm$^2$/30 min. in autoclave | aq. 20% NaOH solution (56) | 48 hr | 9.3 | 1.16 | 1.32 |
| 11 | 7 (50) | 4 (3) | Positively chargeable hydrophilic colloidal silica (4) | 110° C./1.2 kg/cm$^2$/30 min. in autoclave | aq. 20% NaOH solution (56) | 48 hr | 12.2 | 1.02 | 1.30 |
| 12 | 8 (50) | 4 (5) | Positively chargeable hydrophilic colloidal silica (4) | 110° C./1.2 kg/cm$^2$/30 min. in autoclave | aq. 20% NaOH solution (56) | 48 hr | 6.2 | 1.07 | 1.47 |
| 13 | 8 (50) | 1 (5) | Positively chargeable hydrophilic colloidal silica (4) | 110° C./1.2 kg/cm$^2$/30 min. in autoclave | aq. 20% NaOH solution (56) | 48 hr | 5.8 | 1.01 | 1.94 |
| 14 (Comp. Ex.) | 7 (50) | 1 (1) | Positively chargeable hydrophilic colloidal silica (4) | 110° C./1.2 kg/cm$^2$/30 min. in autoclave | aq. 20% NaOH solution (56) | 48 hr | 12.1 | 1.02 | 1.01 |
| 15 (Comp. Ex.) | 8 (50) | 2 (12) | Positively chargeable hydrophilic colloidal silica (4) | 120° C./2.2 kg/cm$^2$/30 min. in autoclave | aq. 20% NaOH solution (56) | 48 hr | 6.5 | 1.07 | 2.13 |
| 16 (Comp. Ex.) | 6 (50) | 2 (10) | Positively chargeable hydrophilic colloidal silica (4) | 105° C./0.5 kg/cm$^2$/30 min. in autoclave | aq. 20% NaOH solution (56) | 48 hr | 9.8 | 1.14 | 2.30 |
| 17 | 9 (50) | 2 (5) | Positively chargeable hydrophilic colloidal silica (4) | 75° C./30 min. | aq. 20% NaOH solution (42) | 48 hr | 9.5 | 1.15 | 1.32 |
| 18 | 10 (50) | 4 (3) | Positively chargeable hydrophilic colloidal silica (4) | 75° C./30 min. | aq. 20% NaOH solution (42) | 48 hr | 12.0 | 1.02 | 1.28 |
| 19 | 11 (50) | 4 (5) | Positively chargeable hydrophilic colloidal silica (4) | 75° C./30 min. | aq. 20% NaOH solution (42) | 48 hr | 6.1 | 1.08 | 1.45 |
| 20 | 11 (50) | 1 (5) | Positively chargeable hydrophilic colloidal silica (4) | 75° C./30 min. | aq. 20% NaOH solution (42) | 48 hr | 5.9 | 1.01 | 1.92 |
| 21 (Comp. Ex.) | 10 (50) | 1 (1) | Positively | 75° C./30 min. | aq. 20% NaOH | 48 hr | 11.9 | 1.02 | 1.01 |

TABLE 1-continued

| Example No. of irregular surface formation | Preparation Example No. of spherical resin particles (parts) | Preparation Example No. of fine resin particles (parts) | Dispersant (parts) | Conditions for immobilization treatment | Conditions for removal of dispersant (parts) | | Properties of particles with irregular surfaces: Volume average particle size (μm) | R/r | L/Q |
|---|---|---|---|---|---|---|---|---|---|
| | | | chargeable hydrophilic colloidal silica (4) | | solution (42) | | | | |
| 22 (Comp. Ex.) | 11 (50) | 2 (12) | Positively chargeable hydrophilic colloidal silica (4) | 75° C./30 min. | aq. 20% NaOH solution (42) | 48 hr | 6.8 | 1.05 | 2.12 |
| 23 (Comp. Ex.) | 9 (50) | 2 (10) | Positively chargeable hydrophilic colloidal silica (4) | 75° C./20 min. | aq. 20% NaOH solution (42) | 48 hr | 9.7 | 1.14 | 2.25 |

EXAMPLE 1

One hundred parts of the color resin particles having irregular surfaces obtained in Example of irregular surface formation (1) and 0.4 parts of fine hydrophobic colloidal silica powder (primary particle size: about 8 mμ, BET specific surface area: 200m$^2$/g) obtained by hydrophobic treatment with hexamethylenedisilazane, were mixed together to prepare toner 1 which has externally deposited silica. Then, 6 parts of the toner 1 and 94 parts of ferrite carrier coated with acrylic resin were mixed together to obtain a binary developing agent.

The thus obtained binary developing agent was subjected to a running test of 30,000 sheets with Canon color copying machine CLC-500. Images with excellent resolution and tone were constantly obtained at an image density of 1.4 or more, without any fogged image or any poor toner cleaning. Toner scattering was not remarkable in the copying machine. No deterioration of externally deposited fine particles was found by electron microscope inspection of toners before and after the test.

EXAMPLE 2

To prepare toner 2, 100 parts of the color resin particles having irregular surfaces obtained in Example of irregular surface formation (2), 0.8 parts of the same fine hydrophobic colloidal silica powder as used in Example 1, and 1.0 parts of strontium titanate having a volume average particle size of about 0.3 μm were mixed together to externally deposit the silica and strontium titanate on the color resin particles. Then. 8 parts of the toner 2 and 92 parts of ferrite carrier coated with acrylic resin were mixed together to prepare a binary developing agent.

The thus obtained binary developing agent was subjected to a running test of 30,000 sheets with Canon color copying machine CLC-500. Images highly exellent in resolution and tone were constantly obtained at an image density of 1.4 or more, without any fogged image or any poor toner cleaning. Toner scattering was not remarkable in the copying machine. No deterioration of externally deposited fine particles was found by electron microscope inspection of toners before and after the test.

EXAMPLE 3

To prepare toner 3, 0.6 parts of the same fine hydrophobic colloidal silica powder as used in Example 1 was externally deposited onto 100 parts of the color resin particles having irregular surfaces obtained in Example of irregular surface formation (3). Then, 6 parts of the toner 3 and 94 parts of ferrite carrier coated with acrylic resin were mixed together to prepare a binary developing agent.

The thus obtained binary developing agent was subjected to a running test of 30,000 sheets with Canon color copying machine CLC-500. Images excellent in resolution and tone were constantly obtained at an image density of 1.4 or more without any fogged image or any poor toner cleaning. Toner scattering was not remarkable in the copying machine. No deterioration of externally deposited fine particles was found by electron microscope inspection of toners before and after the test.

EXAMPLE 4

To prepare toner 4, 0.6 parts fine silica powder treated with amino-modified silicone oil (primary average particle size; about 10 mμ, specific surface area; 180 m$^2$/g) was externally deposited onto 100 parts of the color resin particles having irregular surfaces obtained in Example of irregular surface formation (4).

The thus obtained toner 4 was subjected to a running test of 20,000 sheets in Canon copying machine NP-4835. Images with extremely high resolution were constantly obtained at an image density of 1.3 or more without fogged images. No deterioration of externally deposited particles was found by electron microscope inspection of the toner before and after the test.

EXAMPLE 5

To externally deposit the two kinds of the powder, 100 parts of the color resin particles having irregular surfaces obtained in Example of irregular surface formation (5) was mixed with 0.6 parts of the same fine silica powder (primary particle size: about 0.7 mμ) as in Example 1 and 0.3 parts of polyvinylidene fluoride powder (volume average particle size: about 0.3 μm). Toner 5 was obtained thereby. Then, 6 parts of the toner 5 and 94 parts of ferrite coated with acrylic resin were mixed together to prepare a developing agent.

The thus obtained developing agent was subjected to a running test of 30,000 sheets with Canon color copying machine CLC-500. Images highly excellent in resolution and tone were constantly obtained at an image density of 1.4 or more without any fogged image or any poor toner cleaning. Toner scattering was not remarkable in the copying machine. No deterioration of externally deposited fine particles was found by electron microscope inspection of toners before and after the test.

Change ratios (%) of toners 1 to 5 used in the foregoing Examples 1 to 5 are shown in the following table 2.

| Example No. | Change ratio (%) |
|---|---|
| 1 Toner 1 | 2.6 |
| 2 Toner 2 | 8.9 |
| 3 Toner 3 | 5.2 |
| 4 Toner 4 | 3.0 |
| 5 Toner 5 | 3.3 |

EXAMPLE 6

| | |
|---|---|
| Styrene | 170 parts |
| 2-ethylhexyl acrylate | 30 parts |
| C.I. Pigment Blue 15:3 | 7 parts |
| Paraffin wax (m.p. 155° F.) | 32 parts |
| Cyclized rubber | 10 parts |

The above-mentioned components were heated to 70° C. in a container to dissolve or disperse the components, And then 60 parts of toluene and 10 parts of dimethyl 2,2'-azobisisobutyrate as a polymerization initiator were added thereto to prepare a monomer composition.

Separately, 10 parts of hydrophilic colloidal silica treated with an aminoalkylsilane coupling agent was added to 1,200 parts of deionized water, and the resulting mixture was adjusted to pH with hydrochloric acid to prepare an aqueous dispersion medium. Then, the monomer composition was added to the aqueous dispersion medium, and the resulting mixture was subjected to a recycle dispersion treatment in a Hiline mill, type 25 (made by Tokushu Kiko Kogyo K. K.) at 70° C. and 5,000 rpm in a nitrogen atmosphere for 20 minutes to granulate the monomer composition. Then, the mixture was subjected to polymerization reaction at 70° C. for 10 hours with stirring with paddle blades and then heated to 95° C. to remove toluene therefrom by evaporation over one hour. Then, The reaction product was cooled and admixed with NaOH to dissolve the silica, and then subjected to filtration, water washing and drying, whereby color resin particles were obtained. Particle size of the thus obtained color resin particles was determined by Coulter counter (aperture diameter:100 μm), and it was found that the volume average particle size was 8.2 μm with a sharp particle size distribution. The electron microscope inspection showed that the color resin particles had no breaks but had an irregularity like indents. The color resin particle had $R/r=1.2$ and $L/Q=1.26$.

The thus obtained color resin particles were used to prepare toner 6 for the running test as in Example 5. Images highly excellent in resolution and tone were constantly obtained without fogged images or any poor toner cleaning . No deterioration of externally deposited particles was found by electron microscope inspection of toner before and after the test.

EXAMPLE 7

To prepare toner 7, 100 parts of the color resin particles having irregular surfaces obtained in Example of irregular surface formation (6) was mixed with 0.6 parts of the same fine silica powder as used in Example 1 and 0.3 parts of polyvinylidene fluoride powder (average particle size: about 0.3 μm) to externally deposit the silica and the polyvinylidene fluoride onto the color resin particles. Then, 6 parts of toner 7 and 94 parts of ferrite carrier coated with acrylic resin were mixed together to form a developing agent.

The thus obtained developing agent was subjected to a running test of 30,000 sheets with Canon color copying machine CLC-500. Images highly excellent in resolution and tone were constantly obtained at an image density of 1.4 or more, without any fogged image and any poor toner cleaning. Toner scattering was not remarkable in the copying machine. Decrease of externally deposited fine particles was found by electron microscope inspection of toners before and after the test.

EXAMPLE 8

To prepare toner 8, 100 parts of the color resin particles having irregular surfaces obtained in Example 1 of irregular surface formation were mixed with 0.6 parts of fine silica powder (primary average particle size: about 7 mμ) made hydrophobic with hexamethylenedisilazane to externally deposit the silica onto the color resin particles. 6 parts of the toner 8 was mixed with 94 parts of ferrite carrier coated with acrylic resin to prepare a developing agent.

The thus obtained developing agent was subjected to a running test of 30,000 sheets with Canon color copying machine CLC-500. Images highly excellent in resolution and tone were constantly obtained at an image density of 1.4 or more without any fogged image or any poor toner cleaning. Toner scattering was not remarkable in the copying machine. No deterioration of silica particles was observed by electron microscope inspection of toners before and after the test.

EXAMPLE 9

To prepare toner 9, 100 parts of the color resin particles having irregular surfaces obtained in Example of irregular surface formation (2) were mixed with 0.5 parts of the same fine silica powder as in Example 1 to externally deposit the silica on the color resin particle. 5 parts of toner 9 was mixed with 95 parts of ferrite carrier coated with acrylic resin to prepare a developing agent.

The thus obtained developing agent was subjected to a running test of 30,000 sheets with Canon color copying machine CLC-500. Images excellent in resolution and tone were constantly obtained at an image density of 1.4 or more, without any fogged image or any poor toner cleaning. Toner scattering was not remarkable in the copying machine. No deterioration of silica particles was observed by electron microscope inspection of toners before and after the test.

EXAMPLE 10

To prepare toner 10, 100 parts of the color resin particles having irregular surfaces obtained in Example of irregular surface formation (3) were mixed with 0.8 parts of the same fine silica powder as in Example 1 and 1.0 part of fine strontium titanate powder having a volume average particle size of 0.3 μm to externally deposit the silica and the strontium titanate onto the color resin particles. 8 parts of toner 10 was mixed with 92 parts of ferrite carrier coated with acrylic resin to prepare a developing agent.

The thus obtained developing agent was subjected to a running test of 30,000 sheets with Canon color copying machine CLC-500. Images highly excellent in resolution and tone were constantly obtained at an image density of 1.4 or more, without any fogged image or any poor toner cleaning. Toner scattering was not remarkable in the copying machine. No deterioration of externally deposited fine particles was observed by electron microscope inspection of toners before and after the test.

EXAMPLE 11

γ-aminopropyltrimethoxysilane 0.25 g was added to 1,200 ml of deionized water, and 5 g of hydrophilic colloidal silica was further added thereto. The resulting mixture was heated to 70° C. and dispersed with a T.K type homomixer (type M, made by Tokushu Kiko Kogyo K. K.) at 10,000 rpm for 15 minutes. Then, 1/10 N HCQ was added thereto to make pH of the aqueous dispersion medium 6.

| Separately, the following components: | |
|---|---|
| Styrene | 183 parts |
| 2-ethylhexyl acrylate | 17 parts |
| Paraffin wax (T-550, made by Taisei Kosan K.K.) | 32 parts |
| C.I. Pigment Blue 15:3 | 7 parts |
| di-t-buthylsalicyclic acid metal compound | 3 parts |

were heated to 60° C. in a container and dissolved and dispersed by a T.K. type homomixer to prepare a mixture. Then, 40 parts of toluene and 10 parts of 2,2'-azobis (2,4-dimethylvaleronitrile) as a polymerization initiator were added and dissolved while keeping the mixture at 60° C. to prepare a monomer composition.

Then, the thus prepared monomer composition was added to the aqueous dispersion medium in a 2-1 flask and the resulting mixture was stirred in a nitrogen atmosphere by a T.K. type homomixer at 60° C. and 7,500 rpm for 60 minutes to granulate the monomer composition. Then, polymerization was carried out at 60° C. for 10 hours with stirring with paddle blades, and then the reaction mixture was heated to 95° C. to remove the toluene by evaporation over one hour. Then, the reaction product was cooled, admixed with NaOH to dissolve the silica and then subjected to filtration, water washing and drying, whereby color resin particles were obtained.

Particle size of the thus obtained color resin particles was determined by Coulter counter (aperture diameter: 100 μm, and it was found that the volume average particle size was 9.8 μm with a sharp particle size distribution.

The electron microscope inspection showed that the color resin particles had no breaks on the surfaces, but had irregularity like indents. The color resin particle had $R/r=1.04$ and $L/Q=1.18$.

Then, the thus obtained color resin particles were subjected to the same toner formation (toner 11) end running test as in Example 1. Images excellent in resolution and tone were constantly obtained without fogged images or any poor toner cleaning. No observed by electron microscope inspection of toner before and after the test.

EXAMPLE 12

To prepare toner 12, 100 parts of the color resin particles having irregular surfaces obtained in Example of irregular surface formation (4) were mixed with 0.8 parts of the same fine silica powder as in Example 1 to externally deposit the silica onto the color resin particles. Then, 10 parts of toner 12 was mixed with 90 parts of ferrite carrier coated with acrylic resin to prepare a developing agent.

The thus obtained binary developing agent was subjected to a running test of 20,000 sheets with Canon color copying machine CLC-500. Images highly excellent in resolution and tone were obtained at an image density of 1.4 or more, without any fogged image or any poor toner cleaning. Toner scattering was not remarkable in the copying machine. Recognizable decrease of silica particles was observed by electron microscope inspection of toners before and after the test.

EXAMPLE 13

To prepare toner 13, 100 parts of the color resin particles having irregular surfaces obtained in Example of irregular surface formation (17) were mixed with 0.6 parts of fine silica powder (BET specific surface area:200 $m^2/g$) made hydrophobic with hexamethylenedisilazane to externally deposit the silica onto the color resin particles. Then, 6 parts of toner 13 was mixed with 94 parts of ferrite carrier coated acrylic resin to prepare a developing agent.

The thus obtained developing agent was subjected to a running test of 30,000 sheets with Canon color copying machine CLC-500. Images highly excellent in resolution and tone were obtained at an image density of 1.4 or more, without any fogged image or any poor toner cleaning. Toner scattering was not remarkable in the copying machine. No deterioration of silica particles was found by electron microscope inspection of toners before and after the test.

EXAMPLE 14

To prepare toner 14, 100 parts of the color resin particles having irregular surfaces obtained in Example of irregular surface formation (18) were mixed with 0.5 parts of the same fine silica powder as in Example 13 to externally deposite the silica onto the color resin particles. Then, 5 parts of the toner was mixed with 95 parts of ferrite carrier coated with acrylic resin to prepare a developing agent.

The thus obtained developing agent was subjected to a running test of 30,000 sheets with Canon color copying machine CLC-500. Images excellent in resolution and tone were constantly obtained at an image density of 1.4 or more, without any fogged image or any poor toner cleaning. Toner scattering was not remarkable in the copying machine. No deterioration of silica particles was observed by electron microscope inspection of toners before and after the test.

EXAMPLE 15

To prepare toner 15, 100 parts of the color resin particles having irregular surfaces obtained in Example of irregular surface formation (19) were mixed with 0.8 parts of the same fine silica powder as in Example 18 and 1.0 part of strontium titanate having a volume average particle size of 0.3 μm to externally deposit the silica and strontium titanate onto the color resin particles. Then, 8 parts of toner 15 was mixed with 92 parts of ferrite carrier coated with acrylic resin to prepare a developing agent.

The thus obtained developing agent was subjected to a running test of 30,000 sheets with Canon color copying machine CLC-500. Images highly excellent in resolution and tone were constantly obtained at an image density of 1.4 or more, without any fogged image or any poor toner cleaning. Toner scattering was not remarkable in the copying machine. No deterioration of externally deposited fine particles was observed by electron microscope inspection of toners before and after the test.

EXAMPLE 16

To prepare toner 16, 100 parts of the color resin particles having irregular surfaces obtained in Example of irregular surface formation (20) were mixed with 0.8 parts of the same fine silica powder as in Example 13 to externally deposite the silica onto the color resin particles. Then, 10 parts or of toner 16 was mixed with 90 parts of ferrite carrier coated with acrylic resin to prepare a developing agent.

The thus obtained developing agent was subjected to a running test of 20,000 sheets with Canon color copying machine CLC-500. Images highly excellent in resolution and tone were constantly obtained at an image density of 1.4 or more, without any fogged image or any poor toner cleaning. Toner scattering was not remarkable in the copying machine. Recognizable reduction of silica particles was observed by electron microscope inspection of toners before and after the test.

COMPARATIVE EXAMPLE 1

The spherical color resin particles obtained in preparation Example of spherical color resin particles (2) were subjected to the same toner preparation (comparative toner 1) as in Example 1 and then to image development test. The image density decreased particularly in the continuous copying and the image development was discontinued at the time of image development of 10,000 sheets. The electron microscope inspection of toner surface at the time of the discontination showed that there was no substantial presence of externally deposited particles proving the deterioration.

COMPARATIVE EXAMPLES 2

The color resin particles having irregular surfaces obtained in Example of irregular surface formation (7) were subjected to the same toner formation (comparative toner 2) as in Example 1 and then to image development. The image density started to lower at the time of image development over 20,000 sheets, and the image development was discontinued at the point of image development of 22,000 sheets. It was found by electron microscope inspection of the toner surface at the time of the discontinuation that there was no substantial presence of externally deposited particles proving the deterioration of the toner.

COMPARATIVE EXAMPLE 3

The color resin particles having irregular surfaces obtained in Example of irregular surface formation (8) were subjected to the same toner preparation (comparative toner 3) as in Example 2 and then to image development test. Only images with very poor resolution and tone were obtained, as compared obtained in Example 2.

COMPARATIVE EXAMPLE 4

The color resin particles having irregular surfaces obtained in Example of irregular surface formation (9) were subjected to the same toner preparation (Comparative toner 4) as in Example 2 and then to the image development test. Fogging started at the time of development over 5.000 sheets and the image development was discontinued at the point of the development of 6,000 sheets. The electron microscope inspection of the toner surface at the discontinuation showed that there were free fine resin particles. Also many fine resin particles were attached to the sleeve of the developing unit.

COMPARATIVE EXAMPLE 5

Comparative toner 5 was prepared from 100 parts of the spherical color resin particles prepared in Preparation Example of spherical color resin particles (6). A developing agent was prepared from the Comparative toner 5 in the same manner as in Example 8 and subjected to a running test. Particularly in the continuous copying the image density was lowered and the test was discontinued at the time of copying 10,000 sheets. The electron microscope inspection of the toner surface at the discontinuation showed that there was no externally deposited silica and the deterioration was proved.

COMPARATIVE EXAMPLE 6

Comparative toner 6 was prepared from the color resin particles having irregular surfaces obtained in Example of irregular surface formation (14). A developing agent was prepared from the Comparative toner 6 in the same manner as in Example 7 and subjected to a running test. The image density started to lower at the time of copying of over 20,000 sheets and the test was discontinued at the time of copying 22,000 sheets. The electron microscope inspection of the toner surface at the discontinuation showed that there was no externally deposited silica proving the deterioration of silica.

COMPARATIVE EXAMPLE 7

Comparative toner 7 was prepared from the color resin particles having irregular surfaces obtained in Example of irregular surface formation (15). A developing agent was prepared from the Comparative toner 7 in the same manner as in Example 10 and subjected to a running test. Particularly in the continuous copying the image density was lowered and the test was discontinued at the time of copying 10,000 sheets. The microscope inspection of the toner surface at the the discontinuation showed that there was no presence of externally deposited silica proving that the silica was deteriorated.

COMPARATIVE EXAMPLE 8

Comparative toner 8 was prepared from the color resin particles having irregular surfaces obtained in Example of irregular surface formation (16). A developing agent was formed from the Comparative toner 8 in the same manner as in Example 6 and subjected to a running test. Toner scattering started at the time of copying over 5,000 sheets and the test was discontinued at the time of copying 6,000 sheets. The electron microscope inspection of the toner surface at the discontinuation showed that there were free fine resin particles.

COMPARATIVE EXAMPLE 8

Comparative toner 9 was prepared from the spherical color resin particles obtained in Preparation Example of spherical color resin particles (9). A developing agent was also prepared from the Comparative toner 9 in the same manner as in Example 13 and subjected to a running test. Particularly in the continuous copying the image density was lowered and the test was discontinued at the time of copying 10,000 sheets. The electron microscope inspection of the toner surface at the time of the discontinuation that there was no substantial presence of the externally deposited silica, proving the deterioration.

COMPARATIVE EXAMPLE 10

Comparative toner 10 was prepared from the color resin particles having irregular surfaces obtained in Example of irregular surface formation (21). A developing agent was also prepared from the Comparative toner 10 in the same manner as in Example 14 and subjected to a running test. The image density started to lower at the time of copying over 20,000 sheets and the test was discontinued at the time of copying 22,000 sheets. The electron microscope inspection of the toner surface at the time of the discontinuation showed that there was no presence of externally deposited silica and the silica deterioration.

COMPARATIVE EXAMPLE 11

Comparative toner 11 was prepared from the color resin particles having irregular surfaces obtained in Example of irregular surface formation (22). A developing agent was also prepared from the Comparative toner 11 in the same manner as in Example 16 and subjected to a running test. Particularly in the continuous copying the image density was lowered and the test was discontinued at the time of copying 10,000 sheets. The electron microscope inspection of the toner surface at the time of the discontinuation showed that there was no presence of externally deposited silica proving deterioration.

COMPARATIVE EXAMPLE 12

Comparative toner 12 was prepared from the color resin particles having irregular surfaces obtained in Example of irregular surface formation (23) . A developing agent was also prepared from the Comparative toner 12 in the same manner as in Example 13 and subjected to a running test. Toner scattering started at the time of copying over 5,000 sheets and the test was discontinued at the time of copying 6,000 sheets. The electron microscope inspection of the toner surface at the time of the discontinuation showed that there were free fine resin particles.

Change ratios (%) of the toners used in Examples 6 to 16 and Comparative Examples 1 to 12 are shown in the following Table 3.

TABLE 3

| Example No. (Comp. Ex. No.) | Change ratio (%) |
|---|---|
| Ex. 6 (toner 6) | 4.5 |
| Ex. 7 (toner 7) | 4.8 |
| Ex. 8 (toner 8) | 2.9 |
| Ex. 9 (toner 9) | 12.6 |
| Ex. 10 (toner 10) | 6.0 |
| Ex. 11 (toner 11) | 8.8 |
| Ex. 12 (toner 12) | 3.2 |
| Ex. 13 (toner 13) | 2.5 |

TABLE 3-continued

| Example No. (Comp. Ex. No.) | Change ratio (%) |
|---|---|
| Ex. 14 (toner 14) | 5.7 |
| Ex. 15 (toner 15) | 14.3 |
| Comp. Ex. 1 (Comp. toner 1) | 32.5 |
| Comp. Ex. 2 (Comp. toner 2) | 25.6 |
| Comp. Ex. 3 (Comp. toner 3) | 21.9 |
| Comp. Ex. 4 (Comp. toner 4) | 31.8 |
| Comp. Ex. 5 (Comp. toner 5) | 35.1 |
| Comp. Ex. 6 (Comp. toner 6) | 29.2 |
| Comp. Ex. 7 (Comp. toner 7) | 22.0 |
| Comp. Ex. 8 (Comp. toner 8) | 24.1 |
| Comp. Ex. 9 (Comp. toner 9) | 35.4 |
| Comp. Ex. 10 (Comp. toner 10) | 28.8 |
| Comp. Ex. 11 (Comp. toner 11) | 30.0 |
| Comp. Ex. 12 (Comp. toner 12) | 21.5 |

PREPARATION EXAMPLE OF SPHERICAL MAGNETIC RESIN PARTICLES (1)

| | |
|---|---|
| Styrene | 50 parts |
| 2-ethylhexyl acrylate | 30 parts |
| di-t-butylsalicyclic acid metal compound | 4 parts |
| styrene-methacylic acid-methyl methacrylate copolymer (molar ratio = 88:10:2, Mw = 58,000) | 10 parts |
| styrene slurry containing magnetic particles treated with a silane coupling agent (see below) | 242.4 parts |
| paraffin wax (m.p.: 155° F.) | 32 parts |

The above-mentioned components were heated to a temperature of 70° C. in a container and dissolved and dispersed by a T.K type homomixer to prepare a monomer mixture. Then, 10 parts of dimethyl 2,2'-azobisisobutyrate as a polymerization initiator was added thereto and dissolved while keeping the mixture at a temperature of 70° C. to prepare a monomer composition.

Separately, 0.25 g of γ-aminopropyltrimethoxysilane was added to 1,200 ml of deionized water, and then 5 g of hydrophilic colloidal silica was aded thereto. The thus obtained mixture was heated to a temperature of 70° C. and dispersed by a T.K type homomixer (type M, made by Tokushu Kako Kogyo K. K.) at 10,000 rpm for 15 minutes. Then, 1/10 HCQ was added to the aqueous dispersion to make pH 6.

Then, the monomer composition was added to the aqueous dispersion medium in a 2-Q flask and the mixture was stirred in a nitorogen atmosphere at a temperature of 70° C. by a T.K type homomixer at 7,000 rpm for 60 minutes to granulate the monomer composition. Then, polymerization was carried out at 70° C. for 20 hours, while stirring the mixture with paddle blades. After the completion of the polymerization reaction, the polymerization product was cooled and admixed with NaOH to dissolve the silica, followed by filtration, water washing and drying. Spherical magnetic resin particles colored with the magnetic particles were obtained thereby.

Particle size of the thus obtained spherical magnetic resin particles was determined by Coulten counter (aperture diameter : 100 μm) and the volume average particle size was 11.8 μm with a sharp particle size distribution.

A procedure for preparing the above-mentioned slurry containing magnetic particles treated with a silane coupling agent are explained below: 53 kg of ferrous sulfate was dissolved in 50 Q of water and a solution having an iron concentration of 2.4 moles/Q was prepared while maintaining the liquid temperature at 40° C. or higher by steam heating, and a ratio of Fe (II)/Fe (III) of the solution was adjusted to 50 by blowing air into the solution.

Separately, 560 g of sodium silicate having a $SiO_2$ level of 28% (156.8 g in terms of $SiO_2$) was added to 13 Q of water and dissolved therein. Then after pH adjustment of the solution, the solution was added to the solution of ferrous sulfate to prepare a solution of ferrous sulfate containing a silicate component.

Then, a solution containing 12 kg of sodium hydroxide in 50 Q of water was slowly added to the thus obtained solution of ferrous sulfate containing the silicate component with mechanical stirring to conduct neutralization adjusting the residual sodium hydroxide concentration of the slurry solution of ferrous hydroxide to 2 g/Q. Then, 37 Q/min. of air was blown into the slurry solution of ferrous hydroxide while maintaining the liquid temperature at 85° C., and reaction was completed after 5 hours 30 minutes.

Then, the slurry was filtered and the cake was washed with water and dried, whereby magnetic iron oxide containing silicon element was obtained. The content of silicon element in the thus obtained magnetic iron oxide was determined by plasma emission spectrochemical analysis to be 0.72% by weight on the basis of iron element.

The BET specific surface area of the magnetic particles was found to be 8.4 $m^2/g$. It was also found by transmission type electron microscopic observation of the magnetic particles that magnetic particles were octahedral in shape having an average particle size of 0.25 μm, which contained substantially no spherical particles.

Then, the following components:

| | |
|---|---|
| The thus obtained magnetic particles | 100 parts |
| Styrene monomer | 100 parts |
| Stearyltriethoxysilane | 2 parts |

were mixed together and the mixture was subjected to a dispersion treatment in an ultrasonic disperser (100 kHz, 200 W) for 30 minutes, while heating the mixture to 70° C., whereby the above mentioned styrene slurry containing the magnetic particles treated with the silane coupling agent was obtained.

PREPARATION EXAMPLE OF SPHERICAL MAGNETIC RESIN PARTICLES (2)

| | |
|---|---|
| Styrene | 170 parts |
| 2-ethylhexyl acrylate | 30 parts |
| Cyclized rubber | 20 parts |
| Paraffin Wax (m.p. 155° F.) | 32 parts |
| Magnetic particles treated with a coupling agent [see below] | 140 parts |

The foregoing components were heated to 140° C. in a container and dissolved and dispersed by a T.K type homomixer to prepare a monomer mixture. Then, 10 parts of dimethyl 2,2'-azobis-isobutyrate as a polymerization initiator was aded and dissolved, while maintaining the mixture at 70° C. to prepare a monomer composition.

Separately, 0.5 g of γ-aminopropyltrimethoxysilane was added to 1,200 ml of deionized water, and further 10 g of hydrophilic colloidal silica was added thereto. The resulting mixture was heated to 70° C. and subjected to a dispersion treatment at 10,000 rpm for 15 minutes by a T.K type homomixer (type M, made by Tokushu Kiko Kogyo K. K.). Then, the aqueous dispersion medium was admixed with 1/10 N HCQ to make pH 6.

Then, the monomer composition was added to the aqueous dispersion medium in a 2-Q flask, and the resulting mixture was stirred in a nitrogen atmosphere at 70° C. and 12,000 rpm for 60 minutes by a T.K type homomixer to granulate the monomer composition. Then, the granulated monomer composition was polymerized at 70° C. for 20 hours with stirring by paddle blades. After the completion of the polymerization reaction, the reaction product was cooled, admixed with NaOH to dissolve the silica and then filtered, washed with water and dried, whereby spherical magnetic resin particles were obtained.

Particle size of the thus obtained spherical magnetic resin particles was determined by Coulten counter (aperture diameter : 100 μm). The volume average particle size was 6.2 μm with a sharp particle size distribution.

The above-mentioned magnetic particles treated with the coupling agent were prepared as follows: 100 g of magnetic particles (average particle size : 0.1 μm) and 20 g of tetramethyltetrahydrocyclotetrasiloxane as a coupling agent were placed in separate vessels, respectively, and were left standing at 50° C. for 6 hours in the same desiccator. Then, the magnetic particles were left standing at 50° C. for 2 hours under reduced pressure in a vacuum drier and dried, whereby 100.5 g of the magnetic particles treated with the coupling agent were obtained.

PREPARATION EXAMPLE OF SPHERICAL MAGNETIC RESIN PARTICLES (3)

One hundred parts of polyester resin obtained by condensation of bisphenol A propylene oxide adduct and fumaric acid was subjected to a thorough preliminary mixing with 60 parts of magnetic powder (magnetic iron oxide) and 4 parts of a metal-containing organic compound in a Henschel mixer, and then the mixture was melted and kneaded at least twice in a three-roll mill. After cooling, the kneaded mixture was crushed to the size of about 1 to about 2 m in a hammer mill and then finely pulverized to the size of not more than 30 μm in a pulverizer based on an air jet system to obtain magnetic resin particles having an irregular shape and breaks.

Then, 100 parts of the thus obtained resin particles and 5 parts of hydrophilic colloidal silica treated with an aminoalkylsilane coupling agent were subjected to a preliminary mixing in a Henschel mixer, and then the resulting mixture was added to 500 parts of water, stirred with paddle blades and dispersed. The resulting aqueous dispersion was heated to a temperature of 75° C. with stirring, kept at that temperature for 60 minutes, and then left for cooling. Then, the aqueous dispersion was admixed with sodium hydroxide to dissolve the silica, followed by filtration, washing with water, drying and classification. Spherical magnetic resin particles having a volume average particle size of 8.8 μm were obtained.

PREPARATION EXAMPLE OF SPHERICAL MAGNETIC RESIN PARTICLES (4)

| | |
|---|---|
| Styrene | 170 parts |
| 2-ethylhexyl acrylate | 30 parts |

-continued

| | |
|---|---|
| Styrene-dimethylaminoethyl methacrylate copolymer (molar ratio = 9:1; Mw = 20,000) | 20 parts |
| The same magnetic particles treated with a coupling agent as used in preparation Example of spherical magnetic resin particles (2) | 140 parts |
| Paraffin wax (m.p: 155° F.) | 32 parts |

The above-mentioned components were heated to a temperature of 70° C. in a container and dissolved and dispersed by a M.K type homomixer to prepare a monomer mixture. Then, 10 parts of dimethyl 2,2'-azobisisobutyrate as a polymerization initiator was added and dissolved while keeping the mixture at a temperature of 70° C. to prepared monomer composition.

Separately, 7 g of hydrophilic colloidal silica was added to 1,200 ml of deionized water, and the mixture was heated to 70° C. and subjected to a dispersion treatment by a T.K type homomixer (type M, made by Tokushu Kiko Kogyo K. K.) at 10,000 rpm for 15 minutes to obtain an aqueous dispersion medium.

The monomer composition was added to the aqueous dispersion medium in a 2-Q flask, and stirred in a nitrogen atmosphere by a T.K type homomixier at a temperature of 70° C. and 9,500 rpm for 60 minutes to granulate the monomer composition. Then, the granulated monomer composition was polymerized at a temperature of 70° C. for 20 hours with stirring by paddle blades. After the completion of polymerization reaction, the reaction product was cooled, admixed with NaOH to dissolve the silica and subjected to filtration, washing with water and drying, whereby spherical magnetic resin particles were obtained.

Particle size of the thus obtained spherical magnetic resin particles was determined by Coulten counter (aperture diameter : 100 μm). The volume average particle size was 8.4 μm with a sharp particle size distribution.

EXAMPLE OF IRREGULAR SURFACE FORMATION (24)-(31)

Any one of the spherical magnetic resin particles obtained in the foregoing preparation Examples of spherical magnetic resin particles (1)-(4), was mixed with any one of the fine resin particles obtained in the foregoing Preparation Examples of fine resin particles for irregular surface formation (1)-(4), and color resin particles having irregular surfaces were prepared in the same manner as in the foregoing Examples of irregular surface formation (1)-(23). Data of the thus prepared color resin particles having irregular surfaces are given in Table 4.

TABLE 4

| Example No. of irregular surface formation | Preparation Example No. of spherical resin particles (parts) | Preparation Example No. of fine resin particles (parts) | Dispersant (parts) | Conditions for immobilization treatment | Conditions for removal of dispersant (parts) | | Properties of particles with irregular surfaces: Volume average particle size (μm) | R/r | L/Q |
|---|---|---|---|---|---|---|---|---|---|
| 24 | 1 (50) | 2 (6) | Positively chargeable hydrophilic colloidal silica (4) | 110° C./1.2 kg/cm²/30 min. in autoclave | aq. 20% NaOH solution (56) | 48 hr | 12.8 | 1.12 | 1.45 |
| 25 | 2 (50) | 4 (4) | Positively chargeable hydrophilic colloidal silica (4) | 110° C./1.2 kg/cm²/30 min. in autoclave | aq. 20% NaOH solution (56) | 48 hr | 6.4 | 1.07 | 1.28 |
| 26 | 1 (50) | 4 (4) | Positively chargeable hydrophilic colloidal silica (4) | 110° C./1.2 kg/cm²/30 min. in autoclave | aq. 20% NaOH solution (56) | 48 hr | 12.0 | 1.03 | 1.10 |
| 27 | 3 (50) | 4 (5) | Positively chargeable hydrophilic colloidal silica (4) | 75° C./30 min. | aq. 20% NaOH solution (56) | 48 hr | 9.0 | 1.05 | 1.20 |
| 28 | 4 (50) | 3 (5) | hydrophilic colloidal silica (4) | 110° C./1.2 kg/cm²/30 min. in autoclave | aq. 20% NaOH solution (56) | 48 hr | 9.4 | 1.17 | 1.38 |
| 29 | 2 (50) | 1 (4) | Positively chargeable hydrophilic colloidal silica (4) | 110° C./1.2 kg/cm²/30 min. in autoclave | aq. 20% NaOH solution (56) | 48 hr | 6.3 | 1.03 | 1.04 |
| 30 (Comp. Ex.) | 1 (50) | 1 (3) | Positively chargeable hydrophilic colloidal silica (4) | 110° C./1.2 kg/cm²/30 min. in autoclave | aq. 20% NaOH solution (56) | 48 hr | 11.9 | 1.01 | 1.01 |
| 31 (Comp. Ex.) | 1 (50) | 2 (10) | Positively chargeable hydrophilic colloidal silica (4) | 105° C./1.2 kg/cm²/30 min. in autoclave | aq. 20% NaOH solution (42) | 48 hr | 12.5 | 1.18 | 2.85 |

EXAMPLE 17

To prepare toner 17, 100 parts of the magnetic resin particles having irregular surfaces obtained in Example of irregular surface formation (24) were mixed with 0.5 parts of fine silica powder (primary average particle size : about 7mμ; BET specific surface area: 200 $m^2/g$) made hydrophobic with hexamethylenedisilazane to externally deposit the silica powder onto the magnetic resin particles.

The thus toner 17 was subjected to a running test of 20,000 sheets with Canon copying machine NP-6650. Images with high resolution were constantly obtained at an image density of 1.3 or more, without any fogged image. No deterioration of externally deposited fine particles was observed by electron microscope inspection of toners before and after the test.

EXAMPLE 18

To prepare toner 18, 100 parts of the magnetic resin particles having irregular surfaces obtained in Example of irregular surface formation (25) were mixed with 0.4 parts of polyvinylidene fluoride powder (average particle size: about 0.3 μm) and 1.0 part of fine silica powder (primary average particle size: about 1.2 mμ; BET specific surface area: 150 $m^2/g$) made hydrophobic with dimethylsilicone oil to externally deposit the polyvinylidene fluoride powder and the silica powder onto the magnetic resin particles.

The thus obtained toner 18 was subjected to a running test of 20,000 sheets with Canon copying machine NP-6650. Images with extremely high resolution and excellent tone were obtained without any poor tonner cleaning. No deterioration of externally deposited fine particles was found by electron microscope inspection of toners before and after the test.

EXAMPLE 19

One hundred parts of the magnetic resin particles having irregular surfaces obtained in Example of irregular surface formation (26) was subjected to the same toner formation (toner 19) as in Example 17 and then the toner 17 was subjected to the same running test as in Example 17. Good images were obtained as in Example 17. No deterioration of externally deposited particles was observed by electron microscope inspection of the toners before and after the test.

EXAMPLE 20

To prepare toner 20, 100 parts of the magnetic resin particles having irregular surfaces obtained in Example of irregular surface formation (27) were mixed with 0.8 parts of the same fine silica powder as used in Example 17 to externally deposit the silica powder onto the magnetic resin particles.

The thus obtained toner 20 was subjected to a running test of 20,000 sheets with Canon copying machine NP-6650. Images with extremely high resolution were constantly obtained. No deterioration of externally deposited fine particles was observed by electron microscope inspection of toners before and after the test.

EXAMPLE 21

To prepare toner 21, 100 parts of the magnetic resin particles having irregular surfaces obtained in Example 28 of irregular surface formation were mixed with 0.6 parts of fine silica powder (primary average particle size : about 1.5 mμ; BET specific surface area: 200 $m^2/g$) treated with amino-modified silicone oil to externally deposit the silica powder onto the magnetic resin particles.

The thus obtained toner 21 was subjected to a running test of 20,000 sheets with Canon copying machine NP-4835 . Images excellent in resolution were Obtained at an image density of 1.3 or more, without any fogged image. No deterioration of externally deposited fine particles was observed by electron microscope inspection of toners before and after the test.

EXAMPLE 22

A monomer composition was prepared in the same manner as in Preparation Example of spherical magnetic resin particles (1) except that 60 parts of toluene was further added when the polymerization initiator was added. The thus prepared monomer composition was added to a 2-Q flask containing the same aqueous dispersion medium as used in preparation Example of spherical magnetic resin particles (1), and the resulting mixture was stirred in a nitrogen atmosphere et a temperature of 70° C. by a T.K type homomixer at 8,500 rpm for 60 minutes to granulate the monomer composition. Then, the granulated monomer composition was subjected to polymerization reaction at a temperature of 70° C. for 8 hours with stirring by paddle blades, and then heated to 95° C. to remove toluene by evaporation over one hour.

Then, the reaction product was cooled, admixed with NaOH to dissolve the dispersant and subjected to filtration, washing with water and drying, whereby magnetic resin particles were Obtained.

Particle size of the thus obtained magnetic resin particles was determined by Coulter counter (aperture diameter: 100 μm). It was found that the volume average particle size was 9.4 μm with a sharp particle size distribution. It was also found by electron microscope inspection of the surfaces of magnetic resin particles that the surfaces had no breaks, but had irregularities like indents. The magnetic resin particle had $R/r=1.08$ and $L/Q=1.12$.

The thus obtained magnetic resin particles having irregular surfaces were subjected to the same toner preparation (toner 22) as in Example 17 and then toner 17 was subjected to the same running test as in Example 17. Good images were stably obtained as in Example 17, and no deterioration of externally deposited particles was observed by electron microscope inspection of toner surfaces before and after the test.

EXAMPLE 23

One hundred parts of the magnetic resin particles obtained in Example 29 of irregular surface formation were subjected to the same toner preparation (toner 23) as in Example 18 and then toner 23 was subjected to the same running test as in Example 18. Good images were stably obtained as in Example 18 without any poor toner cleaning. Decrease of externally deposited particles was found by electron microscope inspection of toners before and after the test.

COMPARATIVE EXAMPLE 13

One hundred parts of the spherical magnetic particles obtained in Preparation Example 1 of spherical magnetic particles were subjected to the same toner preparation (comparative toner 13) as in Example 17 and then comparative toner 13 was subjected to the same running test as in Example 17. Particularly in the continuous copying, the image density was lowered and the test was discontinued at the time of copying 10,000 sheets. The electron microscope inspection of the toner surfaces at the time of the discontinuation showed that there were substantially no externally deposited particles and the toner was deteriorated.

COMPARATIVE EXAMPLE 14

One hundred parts of the magnetic resin particles having irregular surfaces obtained in Example of irregular surface formation (30) were subjected to the same toner preparation (comparative toner 14) as in Example 17, and then the comparative toner 14 was subjected to the same running test as in Example 17. The image density started to lower at the time of copying over 20,000 sheets, and copying was discontinued at the time of copying of 22,000 sheets. No presence of externally deposited particles was observed by electron microscope inspection of the toner surfaces at the time of discontinuation proving that the toner was deteriorated.

COMPARATIVE EXAMPLE 15

One hundred parts of the magnetic resin particles having irregular surfaces obtained in Example of irregular surface formation (31) were subjected to the same toner preparation (comparative toner 15) as in Example 17, and then comparative toner 15 was subjected to the same running test as in Example 17. Image fogging appeared at the time of copying over 5,000 sheets, and copying was discontinued at the time of copying 6,000 sheets. Presence of free fine resin particles was found by electron microscope inspection of toners at the time of the discontinuation. Furthermore, many fine resin particles were found on the sleeve in the developing unit.

Since the surfaces of spherical toner particles have irregularities according to the present invention, deterioration of various additives when used for a prolonged time can be prevented and toner image of good quality can be obtained without any change in the properties when used for a prolonged time.

Change ratios (%) of toners of Examples 17 to 23 and Comparative Examples 13 to 15 are shown in the following Table 5.

TABLE 5

| Example No. | Change ratio (%) |
|---|---|
| 17 (toner 17) | 3.9 |
| 18 (toner 18) | 7.0 |
| 19 (toner 19) | 10.3 |
| 20 (toner 20) | 7.7 |
| 21 (toner 21) | 3.8 |
| 22 (toner 22) | 8.2 |
| 23 (toner 23) | 15.9 |
| Comp. Ex. 13 (comp. toner 13) | 36.5 |
| Comp. Ex. 14 (comp. toner 14) | 31.5 |
| Comp. Ex. 15 (comp. toner 15) | 22.3 |

EXAMPLE 24

| | |
|---|---|
| Styrene | 180 parts |
| 2-ethylhexyl acrylate | 20 parts |
| Styrene-methacrylic acid copolymer (acid value: 56; Mw: 56,000) | 10 parts |
| Paraffin Wax (m.p.: 155° F.) | 20 parts |
| C.I. Pigment yellow 17 | 4 parts |
| Dimethyl 2,2'-azobisisobutyrate as a polymerization initiator | 10 parts |

The above-mentioned components were heated to 70° C. and uniformly dispersed or dissolved to prepare a monomer composition.

Separately, 0.35 parts of γ-aminopropyltrimethoxysilane of deionized water heated to 70° C., and the resulting mixture was stirred by a T.K type homogenizer (made by Tokusyu Kiko Kogyo K. K.) at 1,500 rpm for 5 minutes to make a uniform solution, and then 7 parts of hydrophilic colloidal silica was added thereto. Then, the mixture was stirred again by the homogenizer to make a uniform aqueous dispersion. Then, the aqueous dispersion medium was adjusted to pH 6 with hydrochloric acid.

The monomer composition was added to the aqueous dispersion medium and stirred by a T.K type homogenizer at 6,500 rpm for 15 minutes to granulate the monomer composition. Then, the granulated monomer composition was polymerized for 20 hours with stirring by anchor-shaped blades. Then, the polymerization reaction product was admixed with an alkali to dissolve the colloidal silica, a dispersant, and then subjected to filtration, washing with water and drying, whereby color resin particles having a volume average particle size of 9.1 μm were obtained.

To 60 parts of the thus prepared resin particles were added 5 parts of fine resin particles A prepared in Preparation Example of fine resin particles for irregular surface formation (5), and the resulting mixture was dispersed and mixed in a Henschel mixer to prepare mixed particles.

Separately, 4 parts of hydrophilic colloidal silica treated with an aminosilane coupling agent was dispersed in 600 parts of deionized water to prepare an aqueous dispersion medium, and the mixed particles were added to the thus prepared aqueous dispersion medium and the aqueous dispersion was heated with stirring in an autoclave to conduct an immobilization treatment under conditions of 110° C./1.2 kg/cm$^2$/30 min. After the treatment, the aqueous dispersion was cooled, admixed with an alkali to remove the colloidal silica, and subjected to washing with water, filtration and drying, whereby color resin particles having irregular surfaces were obtained.

The electron microscope inspection of the thus obtained color resin particles having irregular surfaces showed that there were no breakes on the surfaces of the resin particles.

To prepare toner 24, 100 parts of the color resin particles having irregular surfaces were mixed with 0.6 parts of fine silica powder (primary average particle size: 0.7 mμmade hydrophobic with hexamethyldisilazane externally deposit the silica onto the color resin particles. Change ratio of toner 24 was 2%.

Eight parts of the toner 24 was mixed with 92 parts of ferrite carrier coated with acrylic resin to make a binary developing agent.

The thus obtained binary developing agent was subjected to a running test of 30,000 sheets with Canon color copying machine CLC-500. Images with excellent resolution were obtained at an image density of 1.4 or more, without any fogged image.

EXAMPLE 25

Color resin particles having a volume average particle size of 4.9 μm were obtained in the same manner as in Example 1 except that 0.5 parts of γ-aminopropyltrimethoxysilane and 10 parts of hydrophilic colloidal silica were used and the number of revolution of T.K type homogenizer (made by Tokushu Kiko Kogyo K. K.) was 8,000 rpm at the granulation. Then, color resin particles having irregular surfaces were obtained therefrom in the same manner as in Example 24.

The electron microscope inspection of the thus obtained color resin particles having irregular surfaces showed that there were no breaks on the particle surfaces.

To prepare toner 25, 100 parts of the color resin particles having irregular surfaces were mixed with 0.8 parts of the same fine hydrophobic silica powder used in Example 24, and 1.0 parts of strontium titanate having a volume average particle size of 0.3 μm to externally deposit the silica and strontium titanate onto the color resin particles. Change ratio of toner 25 was 8%.

Six parts of the toner 25 was mixed with 94 parts of ferrite carrier coated with acrylic resin to prepare a binary developing agent.

The thus obtained binary developing agent was subjected to a running test of 30,000 sheets with Canon color copying machine CLC-500 Images with excellent resolution were obtained at an image density of 1.4 or more, without any fogged image or any poor toner cleaning.

EXAMPLE 26

One hundred parts of polyester resin obtained by condensation of bisphenol A propylene oxide adduct and fumaric acid was thorough premixed with 5 parts of phthalocyanine pigment represented by the foregoing structural formula (I) and 4.4 parts of a chromium-containing organic compound as a negative charge-controlling agent in a Henschel mixer, and then melted and kneaded at least twice in a three-roll mill. After cooling, the cooled product was crushed to particle size of about 1 to about 2 mm in a hammer mill and finely pulverized to the particle size of not more than 30 μm using a pulverizer based on an air jet system, whereby color resin particles having breaks and irregular surfaces were obtained.

Then, 100 parts of the thus obtained color resin particles and 5 parts of hydrophilic colloidal silica treated with an aminoalkylsilane coupling agent were subjected to preliminary mixing in a Henschel mixer, and then 500 parts of water was added to the resulting mixture. Then, the mixture was stirred by paddle blades to prepare an aqueous dispersion. The aqueous dispersion was heated to a temperature of 75° C. with stirring, kept at that temperature for 10 minutes and left for cooling. Then, the cooled dispersion was admixed with sodium hydroxide to dissolve the silica and subjected to filtration, washing with water, drying and classification, whereby color polyester resin particles having a volume average particle size of 8.5 μm were obtained.

The electron microscope inspection of the thus obtained color resin particles showed that the color resin particles had no breaks, but had a potato-like shape.

To prepare toner 26, 100 parts of the color resin particles of potato-like shape were mixed with 0.6 parts of the hydrophobic fine silica powder used in Example 1 to externally deposit the silica powder onto the color resin particles. Change ratio of toner 26 was 11%.

Eight parts of the toner 26 was mixed with 92 parts of ferrite carrier coated with acrylic resin to prepare a binary developing agent.

The thus obtained binary developing agent was subjected to a running test of 30,000 sheets with Canon color copying machine CLC-500. Images with high resolution were constantly obtained at an image density of 1.4 or more, without any fogged image.

COMPARATIVE EXAMPLE 16

Color polyester resin particles having a volume average particle size of 8.5 μm were obtained in the same manner as in Example 26 except that the time for the spheroidizing treatment was changed from 10 minutes to 60 minutes. The electron microscope inspection of the color resin particles showed that the color resin particles had no breaks and were substantially in a spherical shape.

To prepare comparative toner 16, 100 parts of the thus obtained spherical resin particles were mixed with 0.G parts of the hydrophobic fine silica powder used in Example 24 to externally deposit the silica onto the color resin particles. Change ratio of comparative toner 16 was 25%.

Eight parts of the comparative toner 16 was mixed with 92 parts of ferrite carrier coated with acrylic resin to prepare a binary developing agent.

The thus obtained binary developing agent was subjected to a running test with Canon color copying machine CLC-500. It was found in the continuous copying that the image density was lowered, and the image quality was poor. For example, the image quality was significantly poor at the time of copying 10,000 sheets, as compared with Example 3.

EXAMPLE 27

γ-aminopropyltrimethoxysilane 0.25 g was added to 1,200 ml of deionized water, and 5 g of hydrophilic colloidal silica was further added thereto. The resulting mixture was heated to a temperature of 70° C. and dispersed with a T.K type homomixer (type M, made by Tokusyu Kiko Kogyo K. K.) at 10,000 rpm for 15 minutes. Then, 1/10 NHCQ was added to the aqueous dispersion medium to make pH 6.

| | |
|---|---|
| styrene | 50 parts |
| 2-ethylhexyl methacrylate | 30 parts |
| di-t-butylsalicyclic acid metal compound as negative charge-controlling agent | 4 parts |
| stylene-methacrylic acid-methyl methacrylate copolymer (molar ratio = 88:10:2; Mw = 58,000) | 10 parts |
| styrene slurry containing magnetic particles treated with a silane coupling agent (as prepared in Preparation Example of spherical magnetic resin particles(1)) | 242.2 parts |
| Paraffin Wax (m.p. 155° F.) | 32 parts |

The foregoing components were heated to 70° C. in a container and dissolved and dispersed by a T.K type homomixer to prepare a monomer mixture. Then, 10 parts of dimethyl 2,2'-azobisisobutyrate as a polymerization initiator was added and dissolved while keeping the mixture at 70° C. to prepare a monomer composition.

Then, the thus prepared monomer composition was added to a 2-Q flask containing the aqueous dispersion medium and the resulting mixture was stirred in a nitrogen atmosphere by a T.K type homomixer at 70° C. and 7,000 rpm for 60 minutes to granulate the monomer composition. Then, polymerization was carried out at 70° C. for 20 hours with stirring with paddle blades. After the completion of the polymerization reaction, the reaction product was cooled, admixed with NaOH to dissolve the dispersant and then subjected to filtration, water washing and drying, whereby magnetic color resin particles were obtained.

Particle size of the thus obtained color resin particles was determined by Coulter counter (aperture diameter: 100 μm). The volume average particle size was 11.8 μm with a sharp particle size distribution.

Then, 60 parts of the thus prepared color resin particles were mixed with 5 parts of fine resin particles A prepared in Preparation Example of fine resin particles for irregular surface formation (5) in a Henschel mixer to prepare mixed particles.

Separately, 4 parts of amino-modified colloidal silica was dispersed in 600 parts of deionized water to prepare an aqueous dispersion medium, and the mixed particles were added to the thus prepared aqueous dispersion medium and the aqueous dispersion was heated with stirring in an autoclave to conduct an immobilization treatment under conditions of 110° C./1.2 kg/cm$^2$/30 min. After the treatment, the aqueous dispersion was cooled, admixed with an alkali to remove the colloidal silica, and subjected to washing with water, filtration and drying, whereby color resin particles having irregular surfaces were obtained.

The electron microscope inspection of the thus obtained color resin particles having irregular surfaces showed that there were no breaks on the surfaces of the resin particles.

To prepare toner 27, 100 parts of the color resin particles having irregular surfaces were mixed with 0.6 parts of fine silica powder (primary particle size: about 7 mμ; BET specific surface area: 200 m$^2$/g) made hydrophobic with hexamethyldisilazane to externally deposit the silica onto the color resin particles (one-component developing agent). Change ratio of toner 27 was 7%. When the toner 27 was placed in Canon copying machine NP-6650 to rotate the developing sleeve for 30 minutes, the change ratio of the toner 27 was 5%.

The thus obtained one-component developing agent was subjected to a running test of 30,000 sheets with Canon copying machine NP-6650. Images with high resolution were constantly obtained at an image density of 1.4 or more, without any fogged image.

EXAMPLE 28

γ-aminopropyltrimethoxysilane 0.25 g was added to 1,200 ml of deionized water, and 5 g of hydrophilic colloidal silica was further added thereto. The resulting mixture was heated to 70° C. and dispersed with a T.K type homomixer (type M, made by Tokusyu Kiko Kogyo K. K.) at 10,000 rpm for 15 minutes. Then, 1/10 N HCQ was added to the aqueous dispersion medium to made pH 6.

| | |
|---|---|
| styrene | 170 parts |
| 2-ethylhexyl acrylate | 30 parts |
| cyclized rubber | 20 parts |
| Parffin Wax (m.p. 155° F.) | 32 parts |
| The same magnetic particles as used in Preparation Example of spherical magnetic resin particles (2) | 140 parts |

The above-mentioned components were heated to 70° C. in a container and dissolved and dispersed by a T.K type homomixer to prepare a monomer mixture. Then, 10 parts of dimethyl 2,2'-azobis-isobutyrate as a polymerization initiator was added thereto while keeping the mixture at 70° C. and dissolved therein to prepare a monomer composition.

Then, the thus prepared monomer composition was added to the aqueous dispersion medium in a 2-Q flask and the resulting mixture was stirred in a nitrogen atmosphere by a T.K type homomixer at 70° C. and 12,000 rpm for 60 minutes to granulate the monomer composition. Then, polymerization was carried out at 70° C. for 20 hours with stirring with paddle blades. After the completion of the polymerization reaction, the reaction product was cooled, admixed with NaOH to dissolve the colloidal silica and then subjected to filtration, water washing and drying, whereby magnetic, spherical color resin particles were obtained.

Particle size of the thus obtained spherical color resin particles was determined by Coulten counter (aperture diameter: 100 μm), and the volume average particle size was 6.2 μm with a sharp particle size distribution.

To 50 parts of the thus prepared spherical color resin particles were added 5 parts of fine spherical resin particles A prepared in Preparation Example of fine resin particles for irregular surface formation (5), and the resulting mixture was dispersed and mixed in a Henschel mixer to prepare mixed particles.

Separately, 4 parts of hydrophilic colloidal silica treated with an aminosilane coupling agent was dispersed in 600 parts of deionized water to prepare an aqueous dispersion medium, and the mixed particles were added to the thus prepared aqueous dispersion medium and the aqueous dispersion was heated with stirring in an autoclave to conduct an immobilization treatment under conditions of 110° C./1.2 kg/cm$^2$/30 min. After the treatment, the aqueous dispersion was cooled, admixed with an alkali to remove the colloidal silica, and subjected to washing with water, filtration and drying, whereby color resin particles having irregular surfaces were obtained.

It was found by electron microscope inspection of the thus obtained color resin particles having irregular surface that there were no breaks on the surfaces of the color resin particles.

To prepare toner 27, 100 parts of the color resin particles having irregular surfaces were mixed with 0.88 parts of fine silica powder (BET specific surface area: 200 m$^2$/g) made hydrophobic with hexamethyldisilazane and 1.0 par±of strontium titanate having a volume average particle size of 0.3 μm to externally deposit the silica and the strontium titanate onto the color resin particles (one-component developing agent). Change ratio of toner 28 was 8%. Toner 28 was placed in Canon copying machine NP-6650 to determine the change ratio after rotation of the developing sleeve for 30 minutes, and it was found to be 5%.

The thus obtained one-component developing agent was subjected to a running test of 30,000 sheets with Canon copying machine NP-6650. Images with very high resolution were constantly obtained at an image density of 1.4 or more, without any fogged image or any poor toner cleaning.

EXAMPLE 29

Seven g of hydrophilic colloidal silica was added to 1,200 ml of deionized water. The resulting mixture was heated to 70° C. and dispersed with a T.K type homomixer (type M, made by Tokusyu Kiko Kogyo K. K.) at 10,000 rpm for 15 minutes.

| | |
|---|---|
| styrene | 170 parts |
| 2-ethylhexyl methacrylate | 30 parts |
| styrene-dimethylaminoethyl methacrylate copolymer (molar ratio = 9:1; Mw = 20,000) | 20 parts |
| The same magnetic particles used in Example 28 | 140 parts |
| Paraffin Wax (m.p. 155° F.) | 32 parts |

The above-mentioned components were heated to 70° C. in a container and dissolved and dispersed by a T.K type homomixer to prepare a monomer mixture.

Then, 10 parts of dimethyl 2,2'-azobis-isobutyrate as a polymerization initiator was added thereto while keeping the mixture at 70° C. and dissolved therein to prepare a monomer composition.

Then, the thus prepared monomer composition was added to the aqueous dispersion medium in 2-Q flask and the resulting mixture was stirred in a nitrogen atmosphere by a T.K type homomixer at 70° C. and 9,500 rpm for 60 minutes to granulate the monomer composition. Then, polymerization was carried out at 70° C. for 20 hours with stirring with paddle blades. After the completion of the polymerization reaction, the reaction product was cooled, admixed with NaOH to dissolve the colloidal silica and then subjected to filtration, water washing and drying, whereby spherical color resin particles were obtained.

Particle size of the thus obtained spherical color resin particles was determined by Coulter counter (aperture diameter: 100 μm). The volume average particle size was 8.4 μm with a sharp particle size distribution.

Fifty parts of the thus prepared spherical color resin particles were mixed with 5 parts of fine resin particles B prepared in Preparation Example of fine resin particles for irregular surface formation (6), and the resulting mixture was dispersed and mixed in a Henschel mixer to prepare mixed particles.

Separately, 4 parts of colloidal silica was dispersed in 600 parts of deionized water to prepare an aqueous dispersion medium, and the mixed particles were added to the thus prepared aqueous dispersion medium and the aqueous dispersion was heated with stirring in an autoclave to conduct an immobilization treatment under conditions of 110° C./1.2 kg/cm$^2$/30 min. After the treatment, the aqueous dispersion was cooled, admixed with an alkali to remove the colloidal silica, and subjected to washing with water, filtration and drying, whereby color resin particles having irregular surfaces were obtained.

The electron microscope inspection of the thus obtained color resin particles having irregular surfaces showed that there were no breaks on the surfaces of the resin particles.

To prepare toner 29, 100 parts of the color resin particles having irregular surfaces were mixed with 0.6 parts of silica treated with amino-modified silicone oil to externally deposit the silica onto the color resin particles (one-component developing agent). Change ratio of toner 29 was 9%. Toner 29 was placed in Cannon copying machine NP-6650 to determine the change ratio after rotation of the developing sleeve for 30 minutes, and it was found to be 8%.

The thus obtained one-component developing agent was subjected to a running test of 30,000 sheets with a Canon copying machine NP-6650 remodelled to reversal development system. Images with high resolution were constantly obtained at an image density of 1.4 or more, without any fogged image.

EXAMPLE 30

One hundred parts of polyester resin obtained by condensation of bisphenol A propylene oxide adduct and fumaric acid was premixed with 60 parts of magnetic powder (magnetic iron oxide) and 4 parts of a metal-containing organic compound as a negative charge-controlling agent in a Henschel mixer and then melted and kneaded at least twice in a three-roll mill. After cooling, the cooled product was crushed to the particle size of about 1 to about 2 mm in a hammer mill and finely pulverized to the particle size of not more than 30 μm by a pulverizer based on an air jet system, whereby magnetic color resin particles were obtained.

Then, 100 parts of the thus obtained color resin particles and 5 parts of hydrophilic colloidal silica treated with an aminoalkylsilane coupling agent were subjected to preliminary mixing in a Henschel mixer, and then 500 parts of water was added to the resulting mixture. Then, the mixture was stirred by paddle blades to prepare an aqueous dispersion. The aqueous dispersion was heated to a temperature of 75° C. with stirring, kept at that temperature for 60 minutes and left for cooling. Then, the cooled dispersion was admixed with sodium hydroxide to dissolve the silica and subjected to filtration, washing with water, drying and classification, whereby color resin particles having a volume average particle size of 8.8 μm were obtained.

The electron microscope inspection of the thus obtained color resin particles showed that the color resin particles had no breaks, but had a potato-like shape.

To prepare toner 30, 100 parts of the color resin particles of potato-like shape were mixed with 0.6 parts of the hydrophobic fine silica powder used in Example 24 to externally deposit the silica powder onto the color resin particles (one-component developing agent). Change ratio of toner 30 was 13%. Toner 30 was placed in Canon copying machine NP-6650 to determine the change ratio after rotation of the developing sleeve for 30 minutes, and it was found to be 12%.

The thus obtained one-component developing agent was subjected to a running test of 30,000 sheets with Canon copying machine NP-6650. Images with high resolution were obtained at an image density of 1.4 or more, without any fogged image.

COMPARATIVE EXAMPLE 17

Color polyester resin particles having a volume average particle size of 8.8 μm were obtained in the same manner as in Example 29 except that the time for the sphering treatment was changed from 10 minutes to 60 minutes. The electron microscope inspection of the color resin particles showed that the color resin particles had no breaks and were substantially in a spherical shape.

To prepare comparative toner 17, 100 parts of the thus obtained spherical color resin particles were mixed with 0.6 parts of the hydrophobic fine silica powder used in Example 24 to externally deposit the silica onto the color resin particles (one-component developing agent). Change ratio in the specific surface area of comparative toner 17 was 26%.

The thus obtained one-component developing agent was subjected to a running test with Canon copying machine NP-6650. In the continuous copying, the image density was lowered, and the image quality was poor. For Example, the image quality was significantly poor at the time of copying 10,000 sheets, as compared with that of Example 6.

As described above, a developing agent having a high durability can be obtained in the present invention and thus copy images of high quality can be provided for a prolonged use without any fogged images or scattering.

We claim:

1. A toner for developing an electrostatic image comprising color resin particles and a particulate additive; the color resin particles containing at least a coloring agent and a binding resin, the color resin particles or the basic spherical particles of the color resin particles having been prepared by suspension polymerization, the color resin particles having an irregular shape and being substantially free from sharp protrusions, wherein the color resin particles satisfy the following relationship in the projection chart of the color resin particle:

$$1.04\,l \leqq L < 2.00\,l$$

where l is the circumferential length of maximum inscribed circle of the color resin particle and L is the circumferential length of the color resin particle, the particulate additive having an average particle size of no greater than 1/10 of volume average particle size of the color resin particle;

where the BET specific surface area of the toner changes by no greater than 20% before and after the forced stirring of the toner.

2. The toner according to claim 1, wherein the particulate additive is mixed in an amount of 0.1 to 10 parts by weight on the basis of 100 parts by weight of the color resin particles.

3. The toner according to claim 1, wherein the particulate additive is in an amount of 0.1 to 5 parts weight on the basis of 100 parts by weight of the color resin particles.

4. The toner according to claim 1, wherein the particulate additive is in an amount of 0.1 to 2 parts by weight on the basis of 100 parts by weight of the color resin particles.

5. The toner according to claim 1, wherein the color resin particles have a volume average particle size of 2 to 20 μm.

6. The toner according to claim 1, wherein the color resin particles have a volume average particle size of 3 to 12 μm.

7. The toner according to claim 1, wherein the color resin particles have a volume average particle size of 4 to 10 μm.

8. The toner according to claim 1, wherein the BET specific surface area of the toner changes by no greater than 15% before and after the forced stirring of the toner.

9. The toner according to claim 1, wherein the BET specific surface area of the toner changes by no greater than 10% before and after the forced stirring of the toner.

10. The toner according to claim 1, wherein the color resin particles satisfy the following relationship in the projection chart of the color resin particle:

$$1.00 < R/r \leqq 1.20$$

where R in the radius of minimum circumscribed circle of the color resin particle and r is the radius of maximum inscribed circle of the color resin particle.

11. The toner according to claim 1, wherein the color resin particles are in a mixture with colloidal silica as the particulate additive.

12. The toner according to claim i, wherein the color resin particles are in a mixture with hydrophobic colloidal silica as the particulate additive.

13. The toner according to claim 1, wherein the color resin particles are in a mixture with strontium titanate particles as the particulate additive.

14. The toner according to claim 1, wherein the color resin particles are in a mixture with polyvinylidene fluoride particles as the particulate additive.

15. The toner according to claim 1, wherein the color resin particles are in a mixture with hydrophobic colloidal silica and strontium titanate particles as the particulate additive.

16. The toner according to claim 1, wherein the color resin particles are in a mixture with hydrophobic colloidal silica and polyvinylidene fluoride particles as the particulate additive.

17. The toner according to claim 1, wherein the color resin particles have irregular surfaces formed by depositing fine resin particles on the surfaces of spherical color resin particles.

18. The toner according to claim 17 wherein the color resin particles satisfy the following relationship in the projection chart of the color resin particle:

$$1.00 < R/r \leqq 1.20$$

where R is the radius of minimum circumscribed circle of the color resin particle and r is the radius of maximum inscribed circle of the color resin particle.

19. The toner according to claim 17, wherein the spherical color resin particles are prepared by a suspension polymerization process.

20. The toner according to claim 17, wherein the color resin particles are prepared by mixing spherical color resin particles with fine resin particles, thereby obtaining mixed particles, suspending the mixed particles in a liquid, and subjecting the mixture to a heat treatment, thereby immobilizing the fine resin particles on the surfaces of the spherical color resin particles.

21. The toner according to claim 20, wherein the spherical color resin particles have a volume average particle size of 2 to 20 μm and the fine resin particles have particle sizes of 1/200 to 1/10 of particle sizes of the spherical color resin particles.

22. The toner according to claim 20, wherein the spherical color resin particles have a volume average particle size of 3 to 12 μm and the fine resin particles have particle sizes of 1/200 to 1/10 of the particle sizes of the spherical color resin particles.

23. The toner according to claim 20, wherein the spherical color resin particles have a volume average particle size of 4 to 10 μm and the fine resin particles have particle sizes of 1/200 to 1/10 of the particle size of the spherical color resin particles.

24. The toner according to claim 23, wherein the fine resin particles sizes of 1/100 to 1/10 of the particle sizes of the spherical color resin particles.

25. The toner according to claim 20, wherein the color resin particles satisfy the following relationship in the projection chart of the color resin particle:

$$1.00 < R/r \leqq 1.20$$

where R is the radius of minimum circumscribed circle of the color resin particle and r is the radius of maximum inscribed circle of the color resin particle.

26. The toner according to claim 1, wherein the color resin particles are spherical particles having protuberances protruding from the surface of the basic spherical particles.

27. The toner according to claim 1, wherein the color resin particles are prepared by mixing spherical color resin particles and fine resin particles to produce mixed particles and mechanochemically fixing the fine resin particles on the surfaces of the spherical color resin particles.

28. The toner according to claim 1, wherein the color resin particles are prepared by mixing spherical color resin particles and fine resin particles to make a mixture and fixing the fine resin particles on the surfaces of the spherical color resin particles by heating the mixture in a fluidized heating bed.

29. The toner according to claim 1, wherein the color resin particles are prepared by polymerizing a monomer composition containing fine resin particles and transferring the fine resin particles to the surface of the color resin particles before completing the polymerization.

30. The toner according to claim 1, wherein the color resin particles or the basic spherical particles thereof are particles prepared by suspension polymerization, the particles containing 8–40 parts by weight of a release agent to 100 parts by weight of the resin contained in the particles.

31. The toner according to claim 1, wherein the color resin or the basic spherical particles thereof are particles prepared by suspension polymerization, the particles containing 8–40 parts by weight of paraffin wax to 100 parts by weight of the resin contained in the particles.

* * * * *

UNITED STATES PATENT AND TRADEMARK OFFICE

CERTIFICATE OF CORRECTION

PATENT NO. : 5,219,697

DATED : June 15, 1993

INVENTOR(S) : HIROMI MORI, ET AL.

It is certified that error appears in the above-identified patent and that said Letters Patent is hereby corrected as shown below:

Title Page:

IN [57] ABSTRACT

Line 9, "particles" should read --particle--.

COLUMN 1

Line 10, "elctrostatic" should read --electrostatic--.

COLUMN 2

Line 7, "Publications" should read --Publication--.
Line 8, "36-10231" should read --No. 36-10231--;
"Application" should read --Applications--; and
"Laid Open" should read --Laid-Open--.
Line 18, "patent" should read --Patent--.
Line 29, "couduc-" should read --conduc- --.

COLUMN 3

Line 45, "is" should read --are--.
Line 55, "fewer" should read --less--.
Line 64, "spherodizing" should read --spheroidizing--.
Line 68, "includes," should read --includes:--.

COLUMN 4

Line 4, "etc. ," should read --etc.),--.
Line 36, "melt deposit" should read --melt-deposit--.
Line 60, "Spherodizing" should read --Spheroidizing--.

UNITED STATES PATENT AND TRADEMARK OFFICE

CERTIFICATE OF CORRECTION

PATENT NO. : 5,219,697

DATED : June 15, 1993

INVENTOR(S) : HIROMI MORI, ET AL.

It is certified that error appears in the above-identified patent and that said Letters Patent is hereby corrected as shown below:

COLUMN 5

Line 40, "length Q" should read --length ℓ--.
Line 43, "1.01 Q<L<2.00 l" should read --1.01 ℓ<L<2.00 ℓ--.
Line 45, "1.01 Q," should read --1.01 ℓ,--.
Line 47, "2.00 Q," should read --2.00 ℓ,--.

COLUMN 6

Line 5, "10 000)." should read --10,000).--.
Line 39, "Acid Red i." should read --Acid Red 1,--.
Line 60, "Particularly" should read --Particularly preferable--.
Line 67, "skelton" should read --skeleton--.

COLUMN 7

Line 15, "Xy" should read --$X_4$--.
Line 23, "H" should read --or –H--.
Line 24, "Xy" should read --$X_4$--.
Line 30, "drophobic" should read --drophobic properties--.
Line 42, "polymaizable" should read --polymerizable--.
Line 46, "includes," should read --include,--.
Line 55, "treatment;" should read --treatment,--.
Line 61, "Oe." should read --Oe,--.

COLUMN 8

Line 28, "Salycyclic" should read --Salicylic--.
Line 38, "Canon" should read --Canon)--.
Line 51, "wi&h" should read --with--.

--

UNITED STATES PATENT AND TRADEMARK OFFICE

CERTIFICATE OF CORRECTION

PATENT NO. 5,219,697

DATED June 15, 1993

INVENTOR(S) HIROMI MORI, ET AL.

It is certified that error appears in the above-identified patent and that said Letters Patent is hereby corrected as shown below:

COLUMN 9

Line 26, "eight" should read --weight--

COLUMN 11

Line 9, "di-t-butylsalicyclic" shhould read --di-t-butylsalicylic--.
Line 57, "aperture" should read --(aperture--.
Line 65, "8.5 parts" should read --3.5 parts--.
Line 66, "di-t-butylsalicyclic" should read --di-t-butylsalicylic--.

COLUMN 12

Line 29, "(m.p" should read --(m.p.--.
Line 37, "2,2'-azo." should read --2,2'-azo,--.
Line 48, "5 minutes" should read --15 minutes--.

COLUMN 13

Line 8, "di-t-butylsalicyclic" shhould read --di-t-butylsalicylic--.
Line 15, "revolution" should read --revolutions--.
Line 23, "changed" should read --changed to--.
Line 25, "preparation" should read --Preparation--.
Line 42, "Obtained." should read --obtained.--.
Line 66, "has" should read --was--.

COLUMN 15

Line 6, "obtained" should read --were obtained--.

--

UNITED STATES PATENT AND TRADEMARK OFFICE

CERTIFICATE OF CORRECTION

PATENT NO. : 5,219,697

DATED : June 15, 1993

INVENTOR(S) : HIROMI MORI, ET AL.

It is certified that error appears in the above-identified patent and that said Letters Patent is hereby corrected as shown below:

COLUMN 16

Line 26, "preparation" should read --Preparation--.
Line 28, "preparation" should read --Preparation--.
Line 42, "table 1." should read --Table 1.--.
TABLE 1, "L/Q" should read --L/ℓ--.

COLUMN 18

TABLE 1-continued, "L/Q" should read --L/ℓ--.

COLUMN 19

Line 51, "Then." should read --Then,--.

COLUMN 20

TABLE 1-continued, "L/Q" should read --L/ℓ--.

COLUMN 21

Line 8, "table 2." should read --Table 2.--.
Line 49, "The" should read --the--.
Line 60, "L/Q" should read --L/ℓ--.

COLUMN 23

Line 24, "HCQ" should read --HCℓ--.
Line 33, "di-t-buthylsalicyclic" should read --di-t-butylsalicylic--.
Line 38, "(2,4-dimethylvaleronitrile)" should read --(2,4-dimethylvalenonitrile)--.

UNITED STATES PATENT AND TRADEMARK OFFICE

CERTIFICATE OF CORRECTION

PATENT NO. : 5,219,697

DATED : June 15, 1993

INVENTOR(S) : HIROMI MORI, ET AL.

It is certified that error appears in the above-identified patent and that said Letters Patent is hereby corrected as shown below:

COLUMN 23

Line 56, "100 μm," should read --100 μm),--.
Line 62, "L/Q" should read --L/ℓ--.
Line 65, "end" should read --and--.
Line 68, "No observed" should read --No deterioration of externally deposited particles was observed--.

COLUMN 24

Line 48, "deposite" should read --deposit--.

COLUMN 25

Line 21, "deposite" should read --deposit--.
Line 48, "EXAMPLES" should read --EXAMPLE--.

COLUMN 26

Line 1, "compared obtained" should read --compared to those obtained--.

COLUMN 27

Line 12, "that" should read --showed that--.
Lines 27-28, "and the silica deterioration" should read --, proving deterioration--.

COLUMN 28

Line 22, "di-t-butylsalicyclic" shhould read --di-t-butylsalicylic--.

--

UNITED STATES PATENT AND TRADEMARK OFFICE

CERTIFICATE OF CORRECTION

PATENT NO. : 5,219,697

DATED : June 15, 1993

INVENTOR(S) : HIROMI MORI, ET AL.

It is certified that error appears in the above-identified patent and that said Letters Patent is hereby corrected as shown below:

COLUMN 28

Line 39, "aded" should read --added--.
Line 42, "Kako" should read --Kiko--.
Line 43, ""HCQ" should read --HCℓ--.
Line 46, "2-Q" should read --2-ℓ--.
Line 47, "nitorogen" should read --nitrogen--.
Line 59, "Coulten" should read --Coulter--.
Line 66, "50 Q" should read --50 ℓ--.
Line 67, "2.4 moles/Q" should read --2.4 miles/ℓ--.

COLUMN 29

Line 6, "Q" should read --ℓ--.
Line 11, "50 Q" should read --50 ℓ--.
Line 15, "g/Q." should read --g/ℓ.-- and
"37 Q/min." should read --37 ℓ/min.--.
Line 61, "aded" should read --added--.

COLUMN 30

Line 3, "HCQ" should read --HCℓ--.
Line 6, "2-Q" should read --2-ℓ--.
Line 18, "Coulten" should read --Coulter--.
Line 44, "2 m" should read --2 mm--.

COLUMN 31

Line 11, "M.K" should read --T.K--.
Line 15, "prepared" should read --prepare a--.
Line 63, "2-Q" should read --2-ℓ--.

--

UNITED STATES PATENT AND TRADEMARK OFFICE

CERTIFICATE OF CORRECTION

PATENT NO. : 5,219,697

DATED : June 15, 1993

INVENTOR(S) : HIROMI MORI, ET AL.

It is certified that error appears in the above-identified patent and that said Letters Patent is hereby corrected as shown below:

COLUMN 32

Line 7, "Coulten" should read --Coulter--.
Line 14, "preparation" should read --Preparation--.
TABLE 4, "L/Q" should read --L/ℓ-- and
"105°C./1.2 kg/cm$^2$/30" should read
--105°C./1.2 kg/cm$^2$/20--.

COLUMN 33

Line 27, "tonner" should read --toner--.
Line 68, "Obtained" should read --obtained--.

COLUMN 34

Line 12, "2-Q" should read --2-ℓ--.
Line 25, "Obtained." should read --obtained.--.
Line 35, "L/Q" should read --L/ℓ--.

COLUMN 35

Line 67, "Tokusyu" should read --Tokushu--.

COLUMN 36

Line 39, "breakes" should read --breaks--.
Line 44, "mμmade" should read --mμ made-- and
"exter-" should read --to exter- --.
Line 62, "revolution" should read --revolutions--.

COLUMN 37

Line 15, "CLC-500" should read --CLC-500.--.
Line 23, "thorough" should read --thoroughly--.

--

UNITED STATES PATENT AND TRADEMARK OFFICE

CERTIFICATE OF CORRECTION

PATENT NO. : 5,219,697

DATED : June 15, 1993

INVENTOR(S) : HIROMI MORI, ET AL.

It is certified that error appears in the above-identified patent and that said Letters Patent is hereby corrected as shown below:

COLUMN 38

Line 9, "O.G" should read --0.6--.
Line 30, "Tokusyu" should read --Tokushu--.
Line 31, "NHCQ" should read --N HCℓ--.
Line 34, "styrene" should read --Styrene--.
Line 36, "di-t-butylsalicyclic" shhould read --di-t-butylsalicylic--.
Line 37, "stylene-methacrylic" should read --Styrene-methacrylic--.
Line 39, "styrene" should read --Styrene--.
Line 52, "2-Q" should read --2-ℓ--.

COLUMN 39

Line 40, "Tokusyu" should read --Tokushu--.
Line 42, "HCQ" should read --HCℓ--.
Line 43, "made" should read --make--.
Line 46, "styrene" should read --Styrene--.
Line 48, "cyclized" should read --Cyclized--.
Line 61, "2-Q" should read --2-ℓ--.

COLUMN 40

Line 5, "Coulten" should read --Coulter--.
Line 35, "1.0 par±of" should read --1.0 part of--.
Line 55, "Tokusyu" should read --Tokushu--.
Line 58, "styrene" should read --Styrene--.
Line 60, "styrene-" should read --Styrene- --.

--

UNITED STATES PATENT AND TRADEMARK OFFICE

CERTIFICATE OF CORRECTION

PATENT NO. : 5,219,697

DATED : June 15, 1993

INVENTOR(S) : HIROMI MORI, ET AL.

It is certified that error appears in the above-identified patent and that said Letters Patent is hereby corrected as shown below:

COLUMN 41

Line 6, "2-Q" should read --2-ℓ--.
Line 48, "Cannon" should read --Canon--.

COLUMN 42

Line 40, "sphering" should read --spheroidizing--.
Line 56, "Example," should read --example,--.

COLUMN 43

Line 58, "claim i," should read --claim 1,--.

COLUMN 44

Line 47, "particles sizes" should read --particles have particle sizes--.

Signed and Sealed this

Seventeenth Day of May, 1994

Bruce Lehman

BRUCE LEHMAN

*Commissioner of Patents and Trademarks*

*Attest:*

*Attesting Officer*

--